US011151915B2

(12) United States Patent
Fujikawa

(10) Patent No.: US 11,151,915 B2
(45) Date of Patent: Oct. 19, 2021

(54) ELECTRO-OPTICAL DEVICE, ELECTRONIC APPARATUS, AND INSPECTION METHOD FOR ELECTRO-OPTICAL DEVICE

(71) Applicant: SEIKO EPSON CORPORATION, Tokyo (JP)

(72) Inventor: Shinsuke Fujikawa, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/070,482

(22) Filed: Oct. 14, 2020

(65) Prior Publication Data

US 2021/0110747 A1 Apr. 15, 2021

(30) Foreign Application Priority Data

Oct. 15, 2019 (JP) ..... JP2019-188448

(51) Int. Cl.
*G09G 5/00* (2006.01)
*G09G 3/00* (2006.01)
*G09G 3/36* (2006.01)

(52) U.S. Cl.
CPC ..... *G09G 3/006* (2013.01); *G09G 3/3648* (2013.01); *G09G 3/3674* (2013.01); *G09G 2330/12* (2013.01)

(58) Field of Classification Search
CPC .... G09G 3/006; G09G 3/3648; G09G 3/3674; G09G 2330/04; G09G 2330/12
See application file for complete search history.

(56) References Cited

U.S. PATENT DOCUMENTS 5,936,687 A * 8/1999 Lee ..... G09G 3/006 349/40
8,054,263 B2 * 11/2011 Qi ..... G09G 3/3648 345/87
9,269,293 B2 * 2/2016 Kim ..... G09G 3/3208
9,640,097 B2 * 5/2017 Cai ..... G09G 3/3233
2006/0170641 A1 * 8/2006 Song ..... G09G 3/3696 345/98
2006/0221016 A1 * 10/2006 Nakamura ..... G09G 3/3283 345/82

(Continued)

FOREIGN PATENT DOCUMENTS

JP H07-294952 A 11/1995
JP H08-248430 A 9/1996
JP H10-26750 A 1/1998

(Continued)

*Primary Examiner* — Joe H Cheng
(74) *Attorney, Agent, or Firm* — Oliff PLC

(57) ABSTRACT

An electro-optical device includes a first video line and a second video line adjacent to each other, a first high potential line electrically coupled to the first video line via a first diode, a first low potential line electrically coupled to the first video line via a second diode, a second high potential line electrically coupled to the second video line via a third diode, and a second low potential line electrically coupled to the second video line via a fourth diode. The first diode has an anode electrically coupled to the first video line, the second diode has a cathode electrically coupled to the first video line, the third diode has an anode electrically coupled to the second video line, and the fourth diode has a cathode electrically coupled to the second video line.

6 Claims, 14 Drawing Sheets

(56) References Cited

U.S. PATENT DOCUMENTS

2008/0079001 A1* 4/2008 Umezaki ..... G02F 1/13624
257/59
2016/0327842 A1* 11/2016 Qiao ..... H01L 29/78633

FOREIGN PATENT DOCUMENTS

JP 2006-162701 A 6/2006
JP 2009-229635 A 10/2009
JP 2018-185415 A 11/2018

* cited by examiner

ELECTRO-OPTICAL DEVICE, ELECTRONIC APPARATUS, AND INSPECTION METHOD FOR ELECTRO-OPTICAL DEVICE

The present application is based on, and claims priority from JP Application Serial Number 2019-188448, filed Oct. 15, 2019, the disclosure of which is hereby incorporated by reference herein in its entirety.

BACKGROUND

1. Technical Field

The present disclosure relates to an electro-optical device, an electronic apparatus, and an inspection method for an electro-optical device.

2. Related Art

As one example of an electro-optical device, a liquid crystal panel used as a light valve of a liquid crystal projector is exemplified. Such liquid crystal panel includes a plurality columns of extending scan lines, a plurality rows of data lines, a plurality of pixel electrodes, each pixel electrode being provided correspondingly to each of intersections between the plurality columns of scan lines and the plurality rows of data lines, various circuits, and the like.

The various circuits include a distributor. The plurality rows of data lines are formed into a plurality of blocks in a row. The distributor distributes, to each of the data lines, a video signal supplied from a video line provided correspondingly to each of the blocks.

After the scan lines, the data lines, the video lines, and the like are formed, inspection for determining presence or absence of a defect of the video lines or the like is performed in a process of manufacturing a liquid crystal panel. Size reduction and high definition of a liquid crystal panel have been promoted, and hence an array pitch between mounting terminals is narrow. As a result, it is difficult to bring an inspection probe into direct contact with the mounting terminals. Thus, for example, in JP-A-2018-185415, in a state of a large substrate on which a plurality of liquid crystal panels are attached, inspection is enabled by providing inspection auxiliary lines and the like in peripheral areas of the liquid crystal panels.

However, in the inspection method in JP-A-2018-185415, there is a problem in that a risk of degrading quality of the liquid crystal panel may be caused. Specifically, the inspection auxiliary lines are formed across break lines of the liquid crystal panels, and thus, when the liquid crystal panels are scribed from the large substrate, conductive particles are generated and adhere to the liquid crystal panels. With this, there is a risk that a short-circuit defect and the like may be triggered. Further, it is conceived to provide an inspection circuit including the inspection auxiliary lines, but a size of each of the liquid crystal panels is disadvantageously increased. In view of this, an electro-optical device and an inspection method that enable inspection with excellent reliability without hindering size reduction have been demanded.

SUMMARY

An electro-optical device includes a first video line and a second video line adjacent to each other, a first high potential line electrically coupled to the first video line via a first diode, a first low potential line electrically coupled to the first video line via a second diode, a first mounting terminal and a first inspection terminal that are electrically coupled to the first high potential line, a second mounting terminal and a second inspection terminal that are electrically coupled to the first low potential line, a second high potential line electrically coupled to the second video line via a third diode, a second low potential line electrically coupled to the second video line via a fourth diode, a third mounting terminal and a third inspection terminal that are electrically coupled to the second high potential line, and a fourth mounting terminal and a fourth inspection terminal that are electrically coupled to the second low potential line, the first diode having an anode electrically coupled to the first video line, the second diode having a cathode electrically coupled to the first video line, the third diode having an anode electrically coupled to the second video line, and the fourth diode having a cathode electrically coupled to the second video line.

The electro-optical device described above may further include a scan line driving circuit configured to transmit a scan signal, a scan control line configured to supply a scan data signal to the scan line driving circuit, a third high potential line electrically coupled to the scan control line via a fifth diode, and a third low potential line electrically coupled to the scan control line via a sixth diode, wherein the fifth diode may have an anode electrically coupled to the scan control line, the sixth diode may have a cathode electrically coupled to the scan control line, and the third high potential line and the third low potential line may each be electrically separated from the first high potential line, the first low potential line, the second high potential line, and the second low potential line.

The electro-optical device described above may further include a fifth mounting terminal and a fifth inspection terminal that are electrically coupled to the third high potential line, and a sixth mounting terminal and a sixth inspection terminal that are electrically coupled to the third low potential line, wherein the fifth mounting terminal may be arranged adjacent to the first mounting terminal or the third mounting terminal, and the sixth mounting terminal may be arranged adjacent to the second mounting terminal or the fourth mounting terminal.

The electro-optical device described above may further include a substrate at which the first high potential line, the first low potential line, the second high potential line, and the second low potential line are arranged, and a flexible printed wiring substrate coupled to the substrate, wherein the flexible printed wiring substrate may include a drive integrated circuit (IC), a first wiring line, a second wiring line, a third wiring line, and a fourth wiring line, and the first wiring line electrically coupled to the first high potential line and the second wiring line electrically coupled to the first low potential line may extend through an inside of the drive IC, and the third wiring line electrically coupled to the second high potential line and the fourth wiring line electrically coupled to the second low potential line may extend through the inside of the drive IC.

An electronic apparatus includes the electro-optical device described in any one of the items given above.

An inspection method for an electro-optical device, the electro-optical device including a first video line and a second video line being adjacent to each other, a first high potential line electrically coupled to the first video line via a first diode, a first low potential line electrically coupled to the first video line via a second diode, a second high potential line electrically coupled to the second video line via a third diode, and a second low potential line electrically coupled to the second video line via a fourth diode, the first diode having an anode electrically coupled to the first video line, the second diode having a cathode electrically coupled to the first video line, the third diode having an anode electrically coupled to the second video line, and the fourth diode having a cathode electrically coupled to the second video line, wherein, when voltages that are applied to the first high potential line, the first low potential line, the second high potential line, and the second low potential line are referred to as a first high potential, a first low potential, a second high potential, and a second low potential, respectively, voltages satisfying a relationship of the first high potential≥the first low potential>the second high potential≥the second low potential are applied to the first high potential line, the first low potential line, the second high potential line, and the second low potential line, respectively, and when a short circuit is caused between the first video line and the second video line, a current flowing through the first low potential line, the second diode, the first video line, a short circuit part, the second video line, the third diode, and the second high potential line in this order is detected, and the short circuit caused between the first video line and the second video line is detected.

DESCRIPTION OF EXEMPLARY EMBODIMENTS

First Exemplary Embodiment

Figure 1:
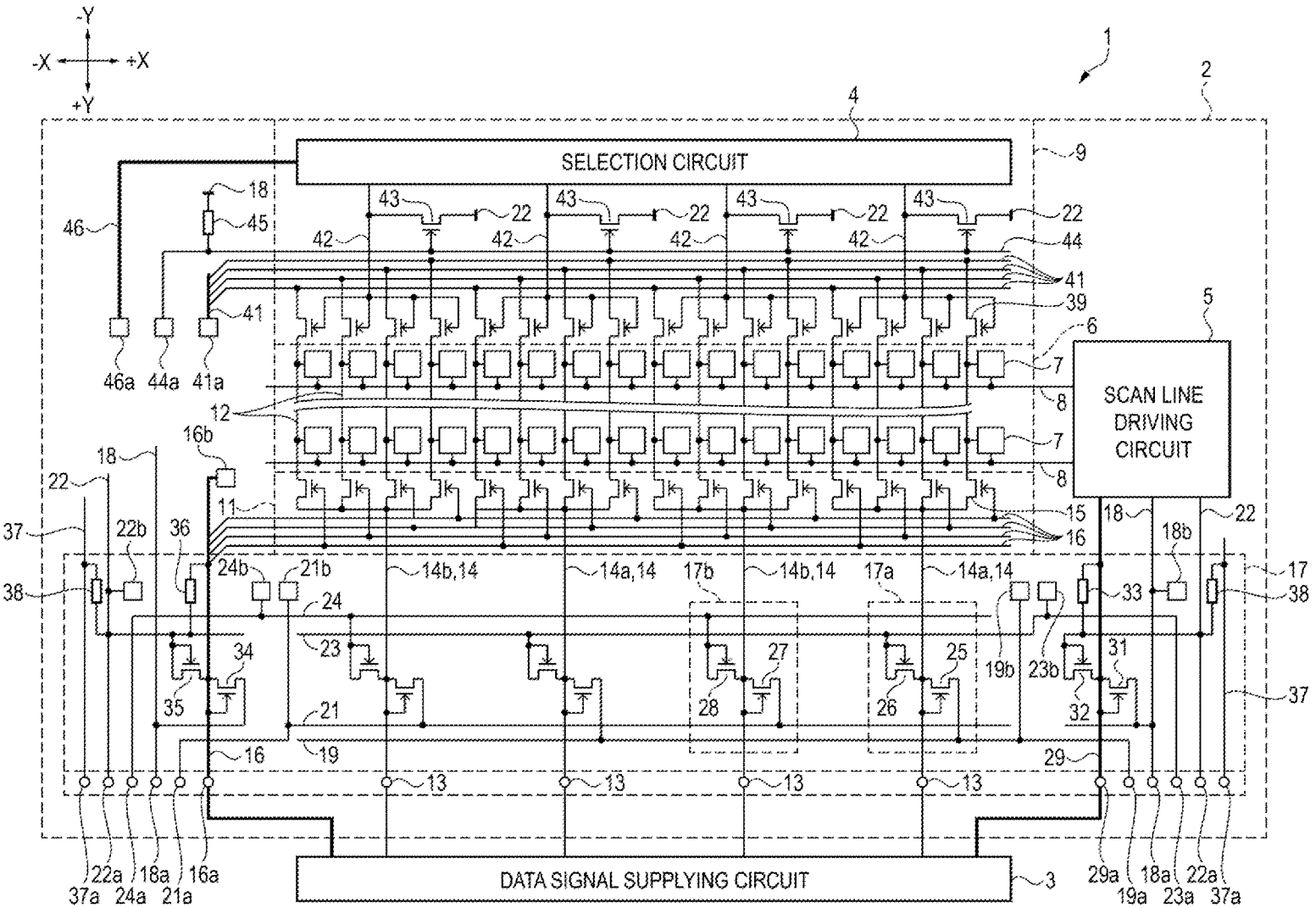
FIG. 1 is a diagram illustrating a configuration of an electro-optical device according to a first exemplary embodiment.

FIG. 1 is a diagram illustrating a configuration of an electro-optical device. As illustrated in FIG. 1, an electro-optical device 1 includes a liquid crystal panel 2 and a data signal supplying circuit 3. The liquid crystal panel 2 is obtained by attaching an element substrate and a counter substrate to each other with a constant gap therebetween. In the gap, for example, a twisted-nematic (TN) type liquid crystal is encapsulated. A selection circuit 4, a scan line driving circuit 5, and the like are formed on the element substrate. The element substrate is coupled to a flexible wiring substrate. A semiconductor chip on which the data signal supplying circuit 3 is formed is mounted on the flexible wiring substrate by a chip-on-film (COF) technique or the like.

A pixel area 6 that displays an image is arranged at the center of the liquid crystal panel 2. Pixels 7 are arranged in a matrix on the pixel area 6. The number of columns and the number of rows of the pixels 7 are not particularly limited, but the pixels 7 in 1,080 columns and 1,920 rows are arranged on the pixel area 6 in this exemplary embodiment, for example. The pixels 7 arranged in two columns and 16 rows are illustrated in the drawing for easy understanding of the drawing.

Directions are set for describing positions of elements and wiring in the drawing. In the drawing, the right side corresponds to a +X direction, and the left side corresponds to a −X direction. In the drawing, the lower side corresponds to a +Y direction, and the upper side corresponds to a −Y direction.

At the center of the drawing, the pixel area 6 is arranged. The scan line driving circuit 5 is arranged in the +X direction of the pixel area 6. A plurality of scan lines 8 are arranged from the scan line driving circuit 5 in the −X direction. The scan line 8 is arranged for each of the columns of the pixels 7. The number of scan lines 8 corresponds to the number of columns of the pixels 7. The scan line driving circuit 5 outputs a scan signal for selecting one scan line 8 from the plurality of scan lines 8. The scan line driving circuit 5 transmits the scan signal to the scan line 8 in each column. The scan signal is switched between a high voltage and a low voltage. In the following description, a state with a high voltage is indicated as an H level, and a state with a low voltage is indicated with an L level. The scan signal is a signal subsequently switched between the H level and the L level.

An inspection circuit 9 is arranged in the −Y direction of the pixel area 6. A distribution circuit 11 is arranged in the +Y direction of the pixel area 6. The distribution circuit 11 is also referred to as a demultiplexer. A plurality of data lines 12 that extend through the pixel area 6, the inspection circuit 9, and the distribution circuit 11 are arranged in the +−Y direction. The data line 12 is arranged for each of the rows of the pixels 7. The data lines 12 and the scan lines 8 are electrically insulated. The number of data lines 12 corresponds to the number of rows of the pixels 7. The distribution circuit 11 selects a specific data line 12, and distributes a data signal. The inspection circuit 9 uses each of the data lines 12, and inspects a short circuit or disconnection regarding each of the data lines. The inspection circuit 9 uses each of the data lines 12, and also inspects a short circuit or disconnection regarding the pixels 7. The data lines 12 are also referred to as gate signal lines or control signal lines.

A pixel transistor formed of an N-type channel thin film transistor or the like is arranged on each of the pixels 7. A gate of the pixel transistor is coupled to the scan line 8. A source of the pixel transistor is coupled to the data line 12. A drain of the pixel transistor is coupled to a pixel electrode. The drain of the pixel transistor and the pixel electrode are coupled to one end of a storage capacitor, and the other end of the storage capacitor is coupled to a capacitance line (not shown). A common potential is applied to the capacitance line.

A common electrode is formed on a surface of the counter substrate, which faces the element substrate. The pixel electrode forms capacitance being the liquid crystal between the pixel electrode and the common electrode. The capacitance is also referred to as a capacitor. The common electrode is common to all the pixels 7. A common potential is applied to the common electrode. In the pixel 7 to which a voltage at the H level is supplied from the scan line 8, a data signal is supplied to the pixel electrode. The twisted state of the liquid crystal is changed in accordance with a voltage of the data signal. A polarization state of light passing through the liquid crystal is changed in accordance with change of the twisted state of the liquid crystal. The liquid crystal panel 2 is sandwiched between polarizing plates, and an amount of light passing through each of the pixels 7 is changed. Specifically, a voltage of the data signal controls an amount of light passing through each of the pixels 7.

The scan line driving circuit 5 subsequently switches the scan lines 8 for suppling a signal at the H level. The distribution circuit 11 subsequently switches the data lines 12 for suppling a data signal. The scan line driving circuit 5 and the distribution circuit 11 subsequently switch the pixels 7 to which a data signal is supplied.

The data signal supplying circuit 3 and the distribution circuit 11 are electrically coupled by a plurality of video lines 14 via video terminals 13. A large number of video line switches 15 are arranged in the distribution circuit 11. The video line switch 15 is arranged for each of the data lines 12. One video line 14 is electrically coupled to four data lines 12 via the video line switch 15. The video line switch 15 is formed of a field effect transistor (FET).

The distribution circuit 11 distributes a data signal, which is transmitted from one video line 14, to four data lines 12. Four first selection lines 16 that are electrically coupled to gates of the video line switches 15 are arranged in the distribution circuit 11. The first selection line 16 transmits a first selection signal. The first selection signal is a signal switched between the H level and the L level. The video line switch 15 to which the first selection signal at the H level transmits a data signal from the video line 14 to the data lines 12.

The four first selection lines 16 are electrically coupled to the data signal supplying circuit 3 via four selection terminals 16*a*. Specifically, one first selection line 16 includes one selection terminal 16*a* and one selection inspection terminal 16*b*. The four selection inspection terminals 16*b* are electrically coupled to the four first selection lines 16. Note that, for easy understanding of the drawing, the selection terminals 16*a* and the selection inspection terminals 16*b* in the drawing are illustrated as integrated terminal marks in an omission form. Wiring between the selection terminals 16*a* and the selection inspection terminals 16*b* are also illustrated as an integrated line in an omission form.

An electrostatic protection circuit 17 is arranged in the +Y direction of the distribution circuit 11. Among the video lines 14, odd-numbered video lines 14 from the scan line driving circuit 5 are referred to as first video lines 14*a*. Among the video lines 14, even-numbered video lines 14 from the scan line driving circuit 5 are referred to as second video lines 14*b*. The first video lines 14*a* and the second video lines 14*b* are adjacent to each other.

The electrostatic protection circuit 17 includes first electrostatic protection circuits 17*a* and second electrostatic protection circuits 17*b*. The first electrostatic protection circuit 17*a* is a circuit for removing static electricity in the first video line 14*a*. The second electrostatic protection circuit 17*b* is a circuit for removing static electricity in the second video line 14*b*.

A high potential line 18 being a third high potential line, a first high potential line 19, a second high potential line 21, a low potential line 22 being a third low potential line, a first low potential line 23, and a second low potential line 24 to which a predetermined voltage is supplied are arranged in the electrostatic protection circuit 17. The high potential line 18 and the low potential line 22 are electrically separated from the first high potential line 19, the first low potential line 23, the second high potential line 21, and the second low potential line 24. The high potential line 18, the first high potential line 19, the second high potential line 21, the low potential line 22, the first low potential line 23, and the second low potential line 24 can be set to voltages different from one another. Further, the high potential line 18, the first high potential line 19, and the second high potential line 21 may be set to the same voltage, and the low potential line 22, the first low potential line 23, and the second low potential line 24 may be set to the same voltage.

A high potential terminal 18*a* being a fifth mounting terminal and a high potential inspection terminal 18*b* being a fifth inspection terminal are electrically coupled to the high potential line 18. A first high potential terminal 19*a* being a first mounting terminal and a first high potential inspection terminal 19*b* being a first inspection terminal are electrically coupled to the first high potential line 19. A second high potential terminal 21*a* being a third mounting terminal and a second high potential inspection terminal 21*b* being a third inspection terminal are electrically coupled to the second high potential line 21.

The high potential line 18 is a wiring line that supplies a high potential voltage to circuits such as the scan line driving circuit 5, the inspection circuit 9, and the electrostatic protection circuit 17. The high potential line 18 is supplied with a high potential voltage from the high potential terminal 18*a*. The high potential inspection terminal 18*b* is a terminal with which a probe is brought into contact when the voltage of the high potential line 18 is supplied for inspection. The low potential line 22 is a wiring line that supplies a low potential voltage to the scan line driving circuit 5 and the inspection circuit 9. The low potential line 22 is supplied with a low potential voltage from a low potential terminal 22*a* being a sixth mounting terminal. A low potential inspection terminal 22*b* being a sixth inspection terminal is a terminal with which a probe is brought into contact when the voltage of the low potential line 22 is supplied for inspection.

The low potential terminal 22*a* and the low potential inspection terminal 22*b* are electrically coupled to the low potential line 22. A first low potential terminal 23*a* being a second mounting terminal and a first low potential inspection terminal 23*b* being a second inspection terminal are electrically coupled to the first low potential line 23. A second low potential terminal 24*a* being a fourth mounting terminal and a second low potential inspection terminal 24*b* being a fourth inspection terminal are electrically coupled to the second low potential line 24.

The first high potential line 19 and the second high potential line 21 are wiring lines that supply a high potential voltage to the electrostatic protection circuit 17. The first high potential line 19 is supplied with a high potential voltage from the first high potential terminal 19*a*. The first high potential inspection terminal 19*b* is a terminal with which a probe is brought into contact when the voltage of the first high potential line 19 is supplied for inspection. The second high potential line 21 is supplied with a high potential voltage from the second high potential terminal 21*a*. The second high potential inspection terminal 21*b* is a terminal with which a probe is brought into contact when the voltage of the second high potential line 21 is supplied for inspection.

The first low potential line 23 and the second low potential line 24 are wiring lines that supply a low potential voltage to the electrostatic protection circuit 17. The first low potential line 23 is supplied with a low potential voltage from the first low potential terminal 23*a*. The first low potential inspection terminal 23*b* is a terminal with which a probe is brought into contact when the voltage of the first low potential line 23 is supplied. The second low potential line 24 is supplied with low potential power from the second low potential terminal 24*a*. the second low potential inspection terminal 24*b* is a terminal with which a probe is brought into contact when the voltage of the second low potential line 24 is supplied.

The high potential terminal 18*a* is arranged adjacent to the first high potential terminal 19*a*. The high potential terminal 18*a* is arranged adjacent to the second high potential terminal 21*a*. The low potential terminal 22*a* is arranged adjacent to the first low potential terminal 23*a*. The low potential terminal 22*a* is arranged adjacent to the second low potential terminal 24*a*.

When the pixels 7 are driven, the same voltage is supplied to the first high potential line 19 and the second high potential line 21. The same voltage is supplied to the first low potential line 23 and the second low potential line 24.

The first high potential line 19 and the first video line 14*a* are electrically coupled to each other via a first diode 25. In other words, the first high potential line 19 is electrically coupled to the first video line 14*a* via the first diode 25. An anode of the first diode 25 is electrically coupled to the first video line 14*a*, and a cathode of the first diode 25 is electrically coupled to the first high potential line 19. A potential of the first high potential line 19 is set to a potential higher than that of the data signal. When static electricity causes the first video line 14*a* to have a voltage higher than that of the first high potential line 19, a current passes through the first diode 25 and flows to the first high potential line 19.

The first low potential line 23 and the first video line 14*a* are electrically coupled to each other via a second diode 26. In other words, the first low potential line 23 is electrically coupled to the first video line 14*a* via the second diode 26. A cathode of the second diode 26 is electrically coupled to the first video line 14*a*, and an anode of the second diode 26 is electrically coupled to the first low potential line 23. A potential of the first low potential line 23 is set to a potential lower than that of the data signal. When static electricity causes the first video line 14*a* to have a voltage lower than that of the first low potential line 23, a current passes through the second diode 26 and flows to the first low potential line 23.

The second high potential line 21 and the second video line 14*b* are electrically coupled to each other via a third diode 27. In other words, the second high potential line 21 is electrically coupled to the second video line 14*b* via the third diode 27. An anode of the third diode 27 is electrically coupled to the second video line 14*b*, and a cathode of the third diode 27 is electrically coupled to the second high potential line 21. A potential of the second high potential line 21 is set to a potential higher than that of the data signal. When static electricity causes the second video line 14*b* to have a voltage higher than that of the second high potential line 21, a current passes through the third diode 27 and flows to the second high potential line 21.

The second low potential line 24 and the second video line 14*b* are electrically coupled to each other via a fourth diode 28. In other words, the second low potential line 24 is electrically coupled to the second video line 14*b* via the fourth diode 28. A cathode of the fourth diode 28 is electrically coupled to the second video line 14*b*, and an anode of the fourth diode 28 is electrically coupled to the second low potential line 24. A potential of the second low potential line 24 is set to a potential lower than that of the data signal. When static electricity causes the second video line 14*b* to have a voltage lower than that of the second low potential line 24, a current passes through the fourth diode 28 and flows to the second low potential line 24.

The first diode 25 to the fourth diode 28 are formed by diode-coupling N-type channel transistors. A plurality of types of transistors are arranged on the liquid crystal panel 2. The transistors are diode-coupled, and thus the diodes can be formed in a process of manufacturing the transistors. Therefore, the first diode 25 to the fourth diode 28 can be formed with high productivity. The first diode 25 to the fourth diode 28 may be formed by a general P-N junction or the like.

Scan control lines 29 that supply scan data is electrically coupled to the scan line driving circuit 5. A scan data signal is formed of four signals, and the scan control lines 29 are formed of four wiring lines. The scan data signal includes a clock signal and a start pulse signal. Scan control terminals 29*a* are electrically coupled to the scan control lines 29. The scan data signal is supplied via the scan control terminals 29*a* from the data signal supplying circuit 3. Note that, for easy understanding of the drawing, the scan control terminals 29*a* in the drawing are illustrated as an integrated terminal in an omission form. The scan control lines 29 are also illustrated as an integrated line in an omission form.

In the +X direction of the electrostatic protection circuit 17, the high potential line 18 and each wiring line of the scan control lines 29 are electrically coupled to each other via a fifth diode 31. In other words, the high potential line 18 is electrically coupled to each wiring line of the scan control lines 29 via the fifth diode 31. An anode of the fifth diode 31 is electrically coupled to each wiring line of the scan control lines 29, and a cathode of the fifth diode 31 is electrically coupled to the high potential line 18. A potential of the high potential line 18 is set to a potential higher than that of the scan data signal. When static electricity causes the scan data signal to have a voltage higher than that of the high potential line 18, a current passes through the fifth diode 31 and flows to the high potential line 18.

The low potential line 22 and each wiring line of the scan control lines 29 are electrically coupled to each other via a sixth diode 32. In other words, the low potential line 22 is electrically coupled to the scan control line 29 via the sixth diode 32. A cathode of the sixth diode 32 is electrically coupled to the scan control line 29, and an anode of the sixth diode 32 is electrically coupled to the low potential line 22. A potential of the low potential line 22 is set to a potential lower than that of the data signal. When static electricity causes the scan control line 29 to have a voltage lower than that of the low potential line 22, a current passes through the sixth diode 32 and flows to the low potential line 22. The low potential line 22 and each wiring line of the scan control lines 29 are electrically coupled to each other via a first resistor 33. The first resistor 33 is a resistive element of approximately from a few hundred kΩ to 1 MΩ, for example.

On the −X direction side of the electrostatic protection circuit 17, the high potential line 18 and each wiring line of the first selection lines 16 are electrically coupled to each other via a seventh diode 34. In other words, the high potential line 18 is electrically coupled to each wiring line of the first selection lines 16 via the seventh diode 34. An anode of the seventh diode 34 is electrically coupled to each wiring line of the first selection lines 16, and a cathode of the seventh diode 34 is electrically coupled to the high potential line 18. A potential of the high potential line 18 is set to a potential higher than that of the first selection signal. When static electricity causes the first selection signal to have a voltage higher than that of the high potential line 18, a current passes through the seventh diode 34 and flows to the high potential line 18.

The low potential line 22 and each wiring line of the first selection lines 16 are electrically coupled to each other via an eighth diode 35. In other words, the low potential line 22 is electrically coupled to the first selection line 16 via the eighth diode 35. A cathode of the eighth diode 35 is electrically coupled to the first selection line 16, and an anode of the eighth diode 35 is electrically coupled to the low potential line 22. A potential of the low potential line 22 is set to a potential lower than that of the first selection signal. When static electricity causes the first selection line 16 to have a voltage lower than that of the low potential line 22, a current passes through the eighth diode 35 and flows to the low potential line 22. The low potential line 22 and each wiring line of the first selection lines 16 are electrically coupled to each other via a second resistor 36. The second resistor 36 is a resistive element of approximately from a few hundred kΩ to 1 MΩ, for example. The seventh diode 34 and the eighth diode 35 are arranged for each of the four first selection lines 16. Note that, in the drawing, the seventh diode 34 and the eighth diode 35 are illustrated as one set in an omission form.

A common electrode wiring line 37 is arranged on each side of the liquid crystal panel 2 in the +−X direction. A common electrode terminal 37*a* is electrically coupled to the common electrode wiring line 37. A common electrode voltage being a voltage of the common electrode is supplied from the common electrode terminal 37*a* to the common electrode wiring line 37. The low potential line 22 and the common electrode wiring line 37 are electrically coupled to each other via a third resistor 38. The third resistor 38 is a resistive element of approximately from a few hundred kΩ to 1 MΩ, for example.

In the inspection circuit 9, data line switches 39 are arranged as many as the data lines 12. The data line switch 39 is arranged for each of the data lines 12. The inspection circuit 9 includes inspection lines 41 formed of four wiring lines. One data line 12 is electrically coupled to any one of the four inspection lines 41 via the data line switch 39. The inspection line 41 transmits an inspection signal. The data line switch 39 is formed of an FET. The inspection line 41 is electrically coupled to a source of the FET. A drain of the FET is electrically coupled to the data line 12. Each of the inspection lines 41 is electrically coupled to a data inspection terminal 41*a*. The data inspection terminal 41*a* is a terminal with which a probe is brought into contact for inspection. Note that four data inspection terminals 41*a* are arranged. Only one data inspection terminal 41*a* in the drawing is illustrated in an omission form.

In the selection circuit 4, four second selection lines 42, which are electrically coupled to gates of the data line switches 39 respectively, are arranged. The second selection line 42 transmits a second selection signal. The second selection signal is a signal switched between the H level and the L level. The data line switch 39 to which the second selection signal at the H level is supplied transmits an inspection signal between the inspection line 41 and the data line 12.

The four data line switches 39 form one group. One second selection line 42 is arranged in the one group. The second selection signal switches the data line switches 39 for each group.

Each of the second selection lines 42 is electrically coupled to the selection circuit 4 and an inspection switch 43. The inspection switch 43 is electrically coupled to the low potential line 22 and the second selection line 42. The inspection switch 43 is formed of an FET. In the inspection circuit 9, an inspection switching line 44, which is electrically coupled to a gate of each of the inspection switches 43, is arranged. The inspection switching line 44 is electrically coupled to an inspection switching line terminal 44*a*. The inspection switching line terminal 44*a* is a terminal with which a probe is brought into contact for inspection. The inspection switching line 44 is electrically coupled to the high potential line 18 via a fourth resistor 45. The fourth resistor 45 is a resistive element of approximately from a few hundred kΩ to 1 MΩ, for example.

An inspection selection signal is input from a probe to the inspection switching line terminal 44*a*. The inspection switching line 44 transmits the inspection selection signal. When the inspection selection signal is at the H level, the second selection line 42 has the second selection signal at the L level. When the inspection selection signal is at the L level, the second selection line 42 has the second selection signal at the level at which the selection circuit 4 performs transmission. The second selection signal is a signal switched between the H level and the L level. The data line switch 39 to which the second selection signal at the H level is supplied transmits an inspection signal between the inspection line 41 and the data line 12. More specifically, all drive voltages are input to the selection circuit 4 for inspection, and the inspection selection signal is input from a probe to the inspection switching line terminal 44*a*. The fourth resistor 45 has high resistivity, and hence a potential of the inspection switching line 44 follows the inspection selection signal that is input from a probe. For non-inspection (normal driving), only a voltage from the low potential line 22 is input to the selection circuit 4. The inspection selection signal is not input from a probe to the inspection switching line terminal 44*a*. The inspection switching line 44 is electrically coupled to the high potential line 18 via the fourth resistor 45, and hence a potential of the inspection switching line 44 corresponds to a potential of the high potential line 18. Thus, the inspection switch 43 is turned on, and the second selection line 42 has a potential at the L level. Thus, all the data line switches 39 are turned off, and the inspection lines 41 and the data lines 12 are separated.

A selection control line 46 is electrically coupled to the selection circuit 4. The selection control line 46 is electrically coupled to a selection control line terminal 46*a*. The selection control line terminal 46*a* is a terminal with which a probe is brought into contact for inspection. A selection control signal is input to the selection control line terminal 46*a*. The selection control signal includes a clock signal, a start pulse signal, and a high potential side power source of the selection circuit 4. A plurality of selection control line terminals 46*a* are arranged, but only one selection control line terminal 46*a* is illustrated in the drawing in an omission form.

When inspection for the pixel area 6 is not performed with the inspection signal, the inspection selection signal at the H level is input to the inspection switching line terminal 44*a*. The inspection switch 43 is turned on, and the second selection line 42 has the second selection signal at the L level. The second selection signal at the L level is transmitted to the data line switch 39, and the data line switch 39 is turned off. In this case, the inspection signal of the inspection line 41 is not transmitted to the data line 12.

When inspection for the pixel area 6 is performed with the inspection signal, the inspection selection signal at the L level is input to the inspection switching line terminal 44*a*. The inspection switch 43 is turned off, and the second selection signal is supplied from the selection circuit 4 to the second selection line 42. The second selection signal is transmitted to the gate of the data line switch 39, and the data line switch 39 is switched. The selection circuit 4 converts the second selection signal supplied to a group including the data line switch 39 corresponding to a row of the pixels 7 subjected to inspection, into an H level signal. The data line switch 39 in the group, which has the second selection signal supplied with the H level signal, is turned on, and the inspection signal of the inspection line 41 is transmitted to the data line 12.

When an image is displayed on the pixel area 6, the inspection switching line 44 is at the H level via the fourth resistor 45. Further, the data line switch 39 is turned off, and the electric coupling between the inspection circuit 9 and the pixel area 6 is in a non-coupling state.

The electric coupling between the inspection circuit 9 and the pixel area 6 is maintained as a non-coupling state, and the scan line driving circuit 5 causes a scan signal of only one of the plurality of scan lines 8 to be at the H level and causes the other scan signals to be at the L level. The scan line driving circuit 5 switches the scan signals at the H level, which are supplied to the scan lines 8, subsequently from the −Y direction side to the +Y direction side. When the scan signal at the H level reaches the end in the +Y direction, the scan line driving circuit 5 repeatedly causes the scan signal at the end in the −Y direction to be at the H level. When the scan signal is at the H level in the pixel 7, a voltage of the data signal is input.

The data signal supplying circuit 3 supplies the first selection signal from the selection terminal 16*a* to the first selection line 16. The first selection signal is transmitted to the first selection line 16, and the four video line switches 15 are subsequently switched. The data line 12 in the row including the video line switch 15 is supplied with the data signal from the data signal supplying circuit 3. The data signal is input to the pixel 7 having the scan signal at the H level. Each of the pixels 7 includes capacitance, and maintains a voltage of the input data signal. Brightness of the pixel 7 is changed in response to the input voltage.

Each of the pixels 7 is selected by the scan signal supplied by the scan line driving circuit 5 and the first selection signal supplied by the data signal supplying circuit 3. The data signal is input to the selected pixel 7.

Figure 2:
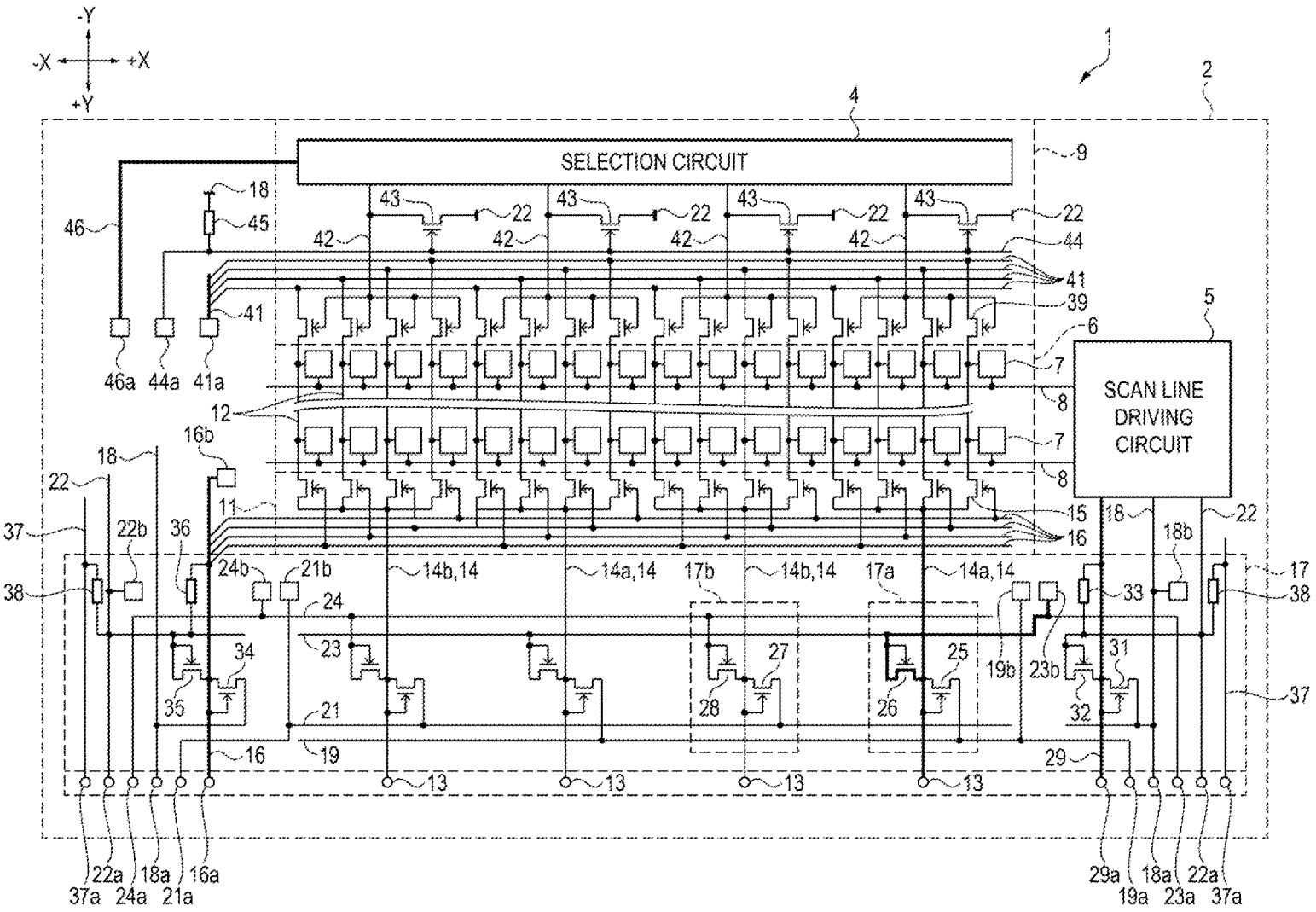
FIG. 2 is a diagram describing short-circuit inspection for video lines.
Figure 3:
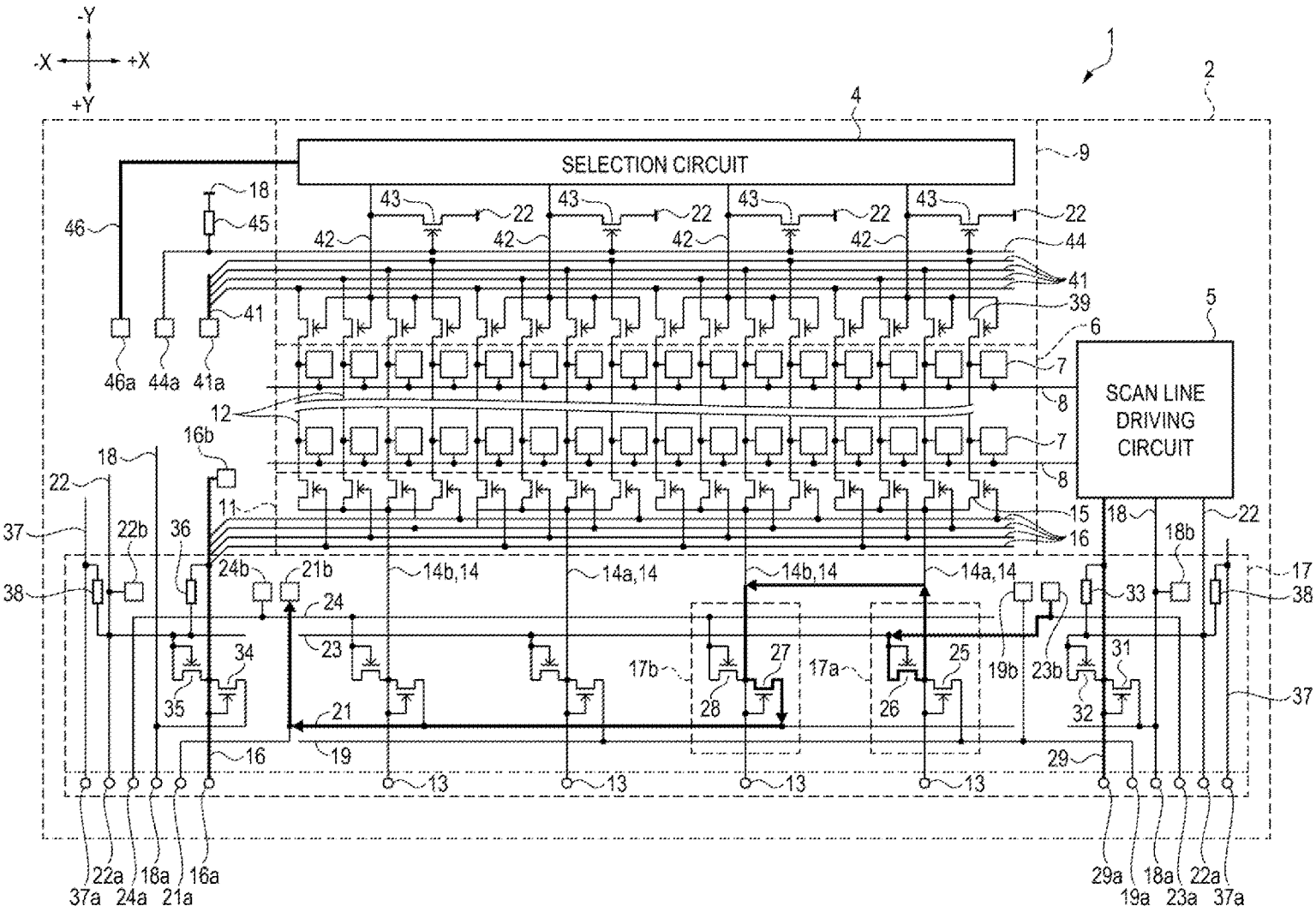
FIG. 3 is a diagram describing short-circuit inspection for video lines.

FIG. 2 and FIG. 3 are diagrams describing short-circuit inspection for the video lines. FIG. 2 is a diagram illustrating a flow of a current when a short circuit is not caused between the first video line 14*a* and the second video line 14*b*. FIG. 3 is a diagram illustrating a flow of a current when a short circuit is caused between the first video line 14*a* and the second video line 14*b*. Next, a method of inspecting a short circuit between the first video line 14*a* and the second video line 14*b* is described.

As illustrated in FIG. 2, the liquid crystal panel 2 is not coupled to the data signal supplying circuit 3. The first selection signal that is input from the selection inspection terminal 16*b* to the first selection line 16 is caused to be at the L level. The video line switch 15 is turned off. The video line 14 and the data line 12 are in a non-coupling state.

Voltages are applied from the high potential inspection terminal 18*b* and the low potential inspection terminal 22*b* to the high potential line 18 and the low potential line 22, respectively, by a probe. The voltages applied to the high potential line 18 and the low potential line 22 are referred to as a third high potential and a third low potential, respectively.

Voltages are applied from the first high potential inspection terminal 19*b*, the first low potential inspection terminal 23*b*, the second high potential inspection terminal 21*b*, and the second low potential inspection terminal 24*b* to the first high potential line 19, the first low potential line 23, the second high potential line 21, and the second low potential line 24, respectively, by a probe. The voltages applied to the first high potential line 19, the first low potential line 23, the second high potential line 21, and the second low potential line 24 are referred to as a first high potential, a first low potential, a second high potential, and a second low potential, respectively. The voltages satisfying a relationship of the first high potential≥the first low potential>the second high potential≥the second low potential are applied to the first high potential line 19, the first low potential line 23, the second high potential line 21, and the second low potential line 24, respectively.

In this exemplary embodiment, for example, the third high potential=15.5 V, the first high potential=14.5 V, the first low potential=10.5 V, the second high potential=5.5 V, the second low potential=1 V, and the third low potential=0 V are satisfied. In this case, the order of the potentials satisfies a relationship of the third high potential>the first high potential>the first low potential>the second high potential>the second low potential>the third low potential.

With the voltage applied to the first low potential inspection terminal 23*b*, a current passes through the first low potential line 23 and the second diode 26 and flows to the first video line 14*a*. The video line switch 15 is in an off state, and a current does not flow to the data line 12. The voltage of the first low potential line 23 is 10.5 V, and the voltage of the first high potential line 19 is 14.5 V. The first high potential has a voltage higher than that of the first low potential, and hence a current does not flow through the first diode 25. In this case, a current flowing between the first high potential inspection terminal 19*b* and the second high potential inspection terminal 21*b* is not detected. A short circuit is not caused between the first video line 14*a* and the second video line 14*b*, and hence a current does not flow from the first video line 14*a* to the second video line 14*b*.

As illustrated in FIG. 3, when a short circuit is caused between the first video line 14*a* and the second video line 14*b*, a current flows from the first video line 14*a* to the second video line 14*b*. The second video line 14*b* is electrically coupled to the second high potential line 21 via the third diode 27. The voltage of the second high potential line 21 is 5.5 V, which is the same as that of the second high potential inspection terminal 21*b*.

A voltage different between the first low potential line 23 and the second high potential line 21 is 5 V, which is calculated from an equation 10.5 V-5.5 V=5 V. Between the first low potential line 23 and the second high potential line 21, a circuit in which the second diode 26 and the third diode 27 are coupled in series is provided.

In this exemplary embodiment, when the N-type transistors forming the first diode 25 to the fourth diode 28, the fifth diode 31, and the sixth diode 32 are diode-coupled, a current of approximately 100 nA can flow between an anode and a cathode with a voltage of 2 V, for example (in a case where a channel width W is 20 μm and a channel length L is 5 μm). The channel width W of each of the first diode 25 to the fourth diode 28 is a few hundred μm. Thus, in a case of the two diodes coupled in series, a current that can be detected can flow sufficiently with a voltage of 4 V.

A current flowing between the first low potential inspection terminal 23*b* and the second high potential inspection terminal 21*b* is detected, and whether a short circuit is caused between the first video line 14*a* and the second video line 14*b* is determined. Specifically, when a short circuit is caused between the first video line 14*a* and the second video line 14*b*, a current that flows subsequently through the first low potential line 23, the second diode 26, the first video line 14*a*, the second video line 14*b*, the third diode 27, and the second high potential line 21 is detected, and a short-circuit between the first video line 14*a* and the second video line 14*b* is detected.

In this exemplary embodiment, a current flowing between the first low potential inspection terminal 23*b* and the second high potential inspection terminal 21*b* is approximately from several μA to 1 mA, for example. When a value of a current flowing between the first low potential inspection terminal 23*b* and the second high potential inspection terminal 21*b* is adjusted, voltages that are applied to the first low potential inspection terminal 23*b* and the second high potential inspection terminal 21*b* may be adjusted in consideration of characteristics of the second diode 26 and the third diode 27.

When a short circuit is not caused between the first video line 14*a* and the second video line 14*b*, for example, a leakage current from the first high potential inspection terminal 19*b* to the first low potential inspection terminal 23*b* is present in the first electrostatic protection circuit 17*a*. The leakage current is, for example, sufficiently smaller than 1 nA. In this exemplary embodiment, for example, the number of rows of the pixels 7 in the pixel area 6 is 1,920. The total number of the first electrostatic protection circuits 17*a* and the second electrostatic protection circuits 17*b* is 480 as expressed with an equation 1920/4=480. The number of the first electrostatic protection circuits 17*a* is 240 as expressed with an equation 480/2=240. The total leakage current from the first high potential inspection terminal 19*b* to the first low potential inspection terminal 23*b* is equal to or less than 1 μA. Thus, a threshold value of the current for determining a short-circuit current may be set to 2 μA, for example.

In this exemplary embodiment, for example, when a short circuit is not caused between the first video line 14*a* and the second video line 14*b*, a current of the first low potential inspection terminal 23*b* is an absorption current formed of a leakage current flowing from the first high potential inspection terminal 19*b* to the first low potential inspection terminal 23*b*. When a short circuit is caused between the first video line 14*a* and the second video line 14*b*, a current of the first low potential inspection terminal 23*b* is a discharge current flowing from the first low potential inspection terminal 23*b* to the second high potential inspection terminal 21*b* because the short-circuit current is larger than the leakage current. Thus, an orientation of the current of the first low potential inspection terminal 23*b* may be used for determination.

In addition, for example, the third high potential=15.5 V, the first high potential=10.5 V, the first low potential=10.5 V, the second high potential=5.5 V, the second low potential=5.5 V, and the third low potential=0 V may be satisfied. In this case, the order of the potentials satisfies a relationship of the third high potential>the first high potential=the first low potential>the second high potential=the second low potential>the third low potential.

In a case where the potentials are set in this manner, when a short circuit is not caused between the first video line 14*a* and the second video line 14*b*, the leakage current flowing from the first high potential line 19 to the first low potential line 23, which is present in the first electrostatic protection circuit 17*a*, is not generated. Thus, accuracy for short-circuit current determination can be improved.

In order to release a residual charge within the liquid crystal panel 2 and prevent electrostatic breakdown in the process, there is known a configuration in which an image signal line inside the liquid crystal panel 2 is coupled to the third low potential via a resistor of approximately 1 MΩ. When this configuration is simply applied to this exemplary embodiment, all the video lines 14 are coupled to the low potential lines 22 via the resistors. In this case, a current flowing from the first low potential inspection terminal 23*b* to the low potential inspection terminal 22*b* is generated. When the first low potential is 10 V, a current of approximately 10 μA flows through each of the video lines 14.

However, the number of the video lines 14, which are coupled to the first low potential inspection terminals 23*b* via the second diodes 26, is 240, and hence a current of 2,400 μA or more is superposed on a current that is to be detected for inspection. Thus, detection of a current in a case of a short circuit is difficult. Further, display unevenness may be caused during normal driving. Therefore, it is preferred that a coupling resistor for the low potential line 22 be prevented from being provided to the video line 14. When a residual charge within the liquid crystal panel 2 is released, a method of releasing charges of all the video lines 14 during an off-sequence period of the liquid crystal panel 2 is preferred.

In the drawing, the flow of the current when a short circuit is caused between the first video line 14*a* and the second video line 14*b* on the end on the +X direction side is illustrated. A current similarly flows in the other video lines 14 when a short circuit is caused between the first video line 14*a* and the second video line 14*b* that are adjacent to each other.

(1) With the configuration of the electro-optical device 1 and the inspection method of the electro-optical device 1 according to this exemplary embodiment, a current flowing between the first low potential inspection terminal 23*b* and the second high potential inspection terminal 21*b* can be detected, and whether a short circuit is caused between the first video line 14*a* and the second video line 14*b* can be detected.

For short-circuit inspection, a method of arranging an inspection terminal to each of the first video lines 14*a* and the second video lines 14*b* is conceivable. In this method, a large number of inspection terminals are required, and hence arrangement is difficult. As compared to this method, short-circuit inspection between the first video line 14*a* and the second video line 14*b* can be performed because the electro-optical device 1 uses the first diode 25 to the fourth diode 28, which form an existing electrostatic protection circuit, and the first high potential inspection terminal 19*b*, the first low potential inspection terminal 23*b*, the second high potential inspection terminal 21*b*, and the second low potential inspection terminal 24*b* are provided. Thus, even when the number of the first video lines 14*a* and the number of the second video lines 14*b* are large, inspection with excellent reliability can be performed without hindering size reduction.

(2) With the configuration of the electro-optical device 1 according to this exemplary embodiment, the high potential line 18 and the low potential line 22 are electrically separated from the first high potential line 19, the first low potential line 23, the second high potential line 21, and the second low potential line 24. Thus, short-circuit inspection between the first video line 14*a* and the second video line 14*b* can be performed without hindering an operation of the scan line driving circuit 5.

(3) With the configuration of the electro-optical device 1 according to this exemplary embodiment, the high potential terminal 18*a* is arranged adjacent to the first high potential terminal 19*a* and the second high potential terminal 21*a*. The low potential terminal 22*a* is arranged adjacent to the first low potential terminal 23*a* and the second low potential terminal 24*a*. After inspection is completed, a voltage with the same potential may be applied to the first high potential terminal 19*a*, the second high potential terminal 21*a*, and the high potential terminal 18*a*. Further, a voltage with the same potential may be applied to the first low potential terminal 23*a*, the second low potential terminal 24*a*, and the low potential terminal 22*a*.

The high potential terminal 18*a* is arranged adjacent to the first high potential terminal 19*a* and the second high potential terminal 21*a*, and hence electric coupling is established easily. The low potential terminal 22*a* is arranged adjacent to the first low potential terminal 23*a* and the second low potential terminal 24*a*, and hence electric coupling is established easily. Thus, a voltage with the same potential can be easily applied to the first high potential terminal 19*a*, the second high potential terminal 21*a*, and the high potential terminal 18*a*. Further, a voltage with the same potential can be easily applied to the first low potential terminal 23*a*, the second low potential terminal 24*a*, and the low potential terminal 22*a*. The terminals having the equal potentials are adjacent to each other, and hence the wiring pattern on the flexible wiring substrate mounted to the element substrate can be simplified. Note that the high potential terminal 18*a* can exert the above-mentioned effect when the high potential terminal 18*a* is adjacent to at least two of the first high potential terminals 19*a* and the second high potential terminals 21*a*. The above-mentioned effect can be exerted when at least two of the first low potential terminal 23*a*, the second low potential terminal 24*a*, and the low potential terminal 22*a* are adjacent to each other.

Second Exemplary Embodiment

This exemplary embodiment is different from the first exemplary embodiment in that disconnection of the data lines 12 in the pixel area 6 is detected. Note that, the descriptions for the points identical to those of the first exemplary embodiment are omitted.

Figure 4:
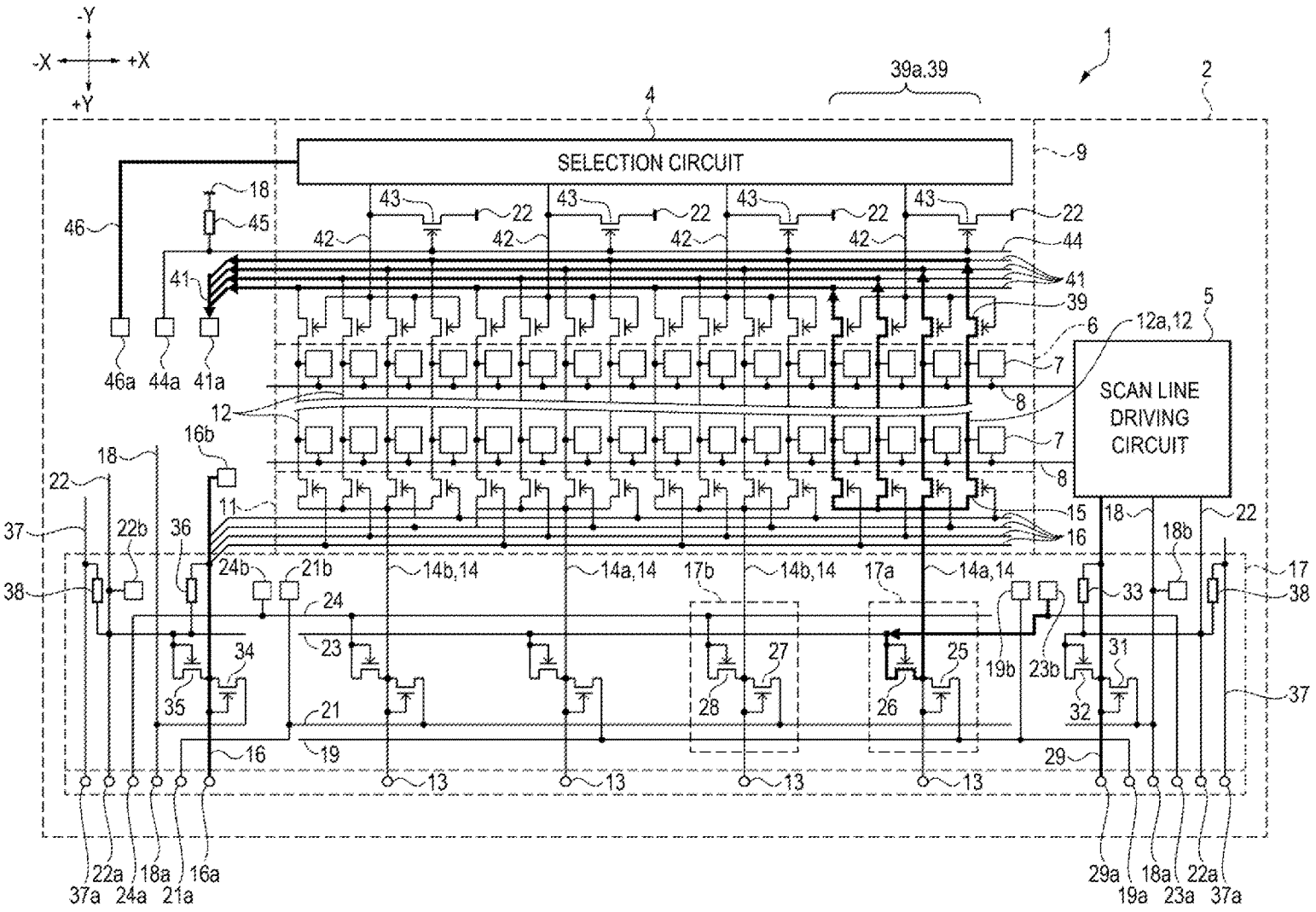
FIG. 4 is a diagram describing disconnection inspection for data lines according to a second exemplary embodiment.
Figure 5:
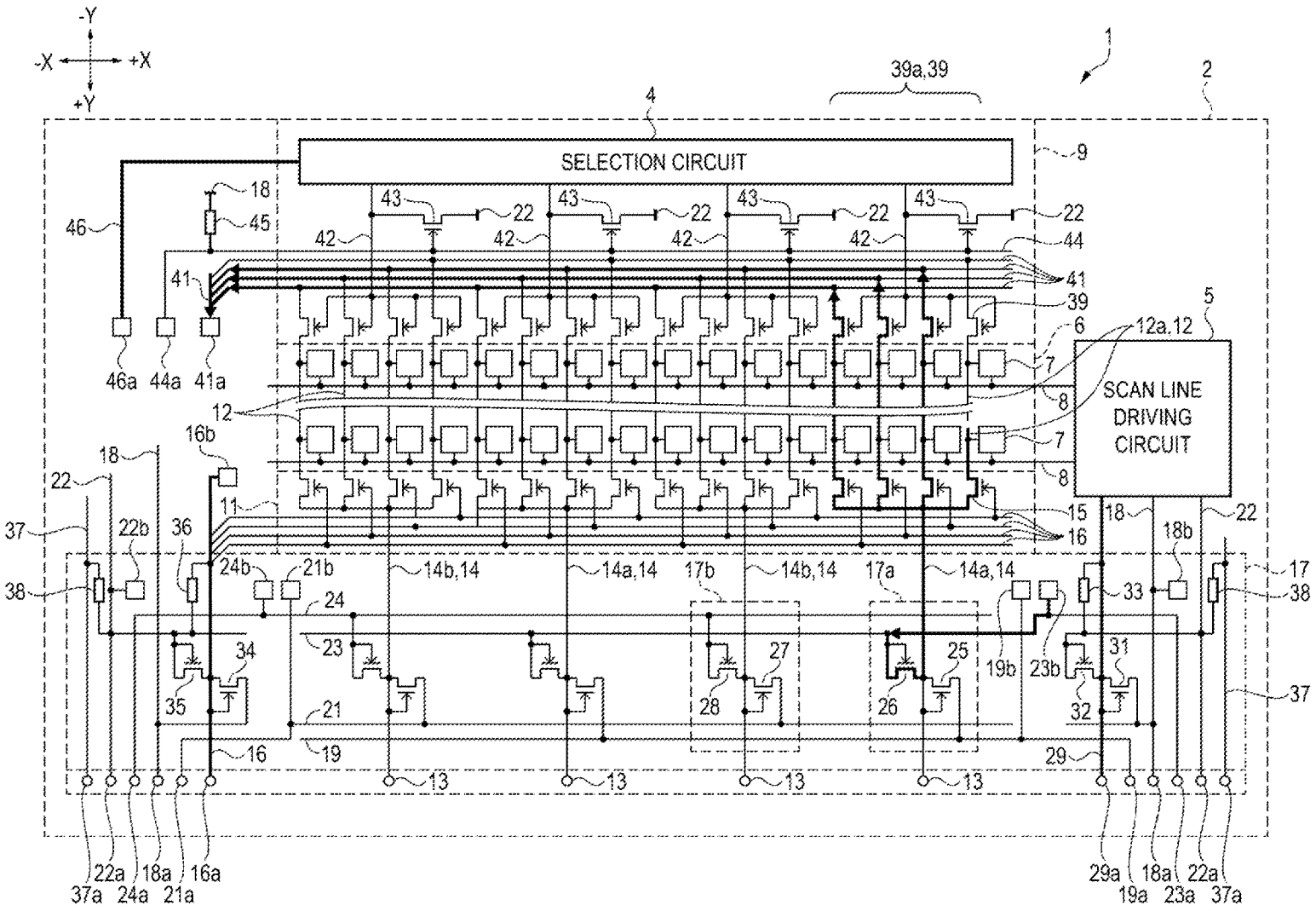
FIG. 5 is a diagram describing disconnection inspection for data lines.

FIG. 4 and FIG. 5 are diagrams describing disconnection inspection for the data lines 12. FIG. 4 is a diagram illustrating a flow of a current when disconnection is not caused in the data lines 12. FIG. 5 is a diagram illustrating a flow of a current when disconnection is partially caused in the data lines 12. Next, a method of inspecting disconnection of the data lines 12 is described.

As illustrated in FIG. 4, the liquid crystal panel 2 is not coupled to the data signal supplying circuit 3. Voltages are applied from the high potential inspection terminal 18*b* and the low potential inspection terminal 22*b* to the high potential line 18 and the low potential line 22, respectively, by a probe. The voltages applied to the high potential line 18 and the low potential line 22 are the third high potential and the third low potential, respectively.

A voltage at the H level is applied from the selection inspection terminal 16*b* to the first selection line 16. The voltage at the H level is the same as the voltage of the third high potential. All the video line switches 15 are turned on. A voltage at the L level is applied to the inspection switching line terminal 44*a*. The voltage at the L level is the same as the voltage of the third low potential. The inspection switch 43 is in an off state.

The selection circuit 4 outputs the second selection signal at the H level to one of the plurality of second selection lines 42, and outputs the second selection signal at the L level to the other second selection lines 42. Further, the selection circuit 4 switches the second selection lines 42 to which the second selection signal at the H level is output, subsequently from the +X direction side to the −X direction side. The voltage of the second selection signal at the H level is referred to as a fourth high potential. The voltage of the fourth high potential is indicated as one voltage signal that is applied to the selection control line terminal 46*a*.

The second selection signal switches the data line switches 39 for each group. Thus, the data line switches 39 are subsequently switched between an on state and an off state for each group. In the drawing, a group of the data line switches 39 on the end in the +X direction is referred to as a first group 39*a*. In the first group 39*a*, the data line switches 39 are in an on state.

The inspection signal having the equal potential being the fixed potential is applied to the four data inspection terminals 41*a*. The voltages satisfying a relationship of the third high potential=the fourth high potential>the first high potential=the first low potential=the second high potential=the second low potential>the inspection signal>the third low potential are applied to the high potential line 18, the second selection line 42, the first high potential line 19, the first low potential line 23, the second high potential line 21, the second low potential line 24, the inspection line 41, and the third low potential, respectively.

In this exemplary embodiment, for example, the third high potential=15.5 V, the fourth high potential=15.5 V, the first high potential=10 V, the first low potential=10 V, the second high potential=10 V, the second low potential=10 V, the inspection signal=2 V, and the third low potential=0 V are satisfied. In this case, the order of the potentials satisfies a relationship of the third high potential=the fourth high potential>the first high potential=the first low potential=the second high potential=the second low potential>the inspection signal>the third low potential.

A potential difference between the first low potential and the inspection signal is set larger than a total voltage drop value of a voltage drop of the second diode 26 in the electrostatic protection circuit 17, a voltage drop of the video line switch 15 in the distribution circuit 11, and a voltage drop of the data line switch 39 in the inspection circuit 9. Note that the voltage drop of the second diode 26 and the voltage drop of the fourth diode 28 are the same.

The voltage of the second low potential inspection terminal 24*b* is 10 V. The voltage of the data inspection terminal 41*a* is 2 V. In the drawing, the data line switches 39 in the first group 39*a* are in an on state. The video line switches 15 are also in an on state.

When the data lines 12 are in a conduction state, a current passes from the first low potential inspection terminal 23*b* through the first low potential line 23 and the second diode 26 and flows to the first video line 14*a*. The voltage of the first high potential line 19 is 10 V, and is higher than the voltage of the first video line 14*a*. Thus, a current does not flow through the first diode 25.

The video line switches 15 are in an on state, and hence a current flows from the first video line 14*a* to the data lines 12. The data line switches 39 are in an on state, and hence a current flows from the data lines 12 to the inspection lines 41. A current flows from the data lines 12 that are electrically coupled to the data line switches 39 in the first group 39*a* to the inspection lines 41.

For example, the voltage drop of the second diode 26 is 2 V. The voltage drop of the video line switch 15 is 2 V. The voltage drop of the data line switch 39 is 2 V. In this case, when the voltage between the first low potential line 23 and the second low potential line 24, and the inspection line 41 is 8 V, a voltage drop due to wiring line resistance is 2 V. Here, the wiring line resistance is a total of resistance of the data line 12, the video line 14, and the inspection line 41. When the wiring line resistance is assumed to be 2 kΩ, a conduction current is expected to be approximately 1 mA.

When the video line 14, the data lines 12, and the inspection lines 41 are in a conduction state, a current flows via the first low potential inspection terminal 23*b*, the video line 14, the data lines 12, the inspection lines 41, and the data inspection terminal 41*a*. The inspection line 41 is provided for each of the four data lines 12 for which the data line switches 39 are simultaneously in an on state. Thus, the four data lines 12 can be simultaneously subjected to inspection. A disconnection defect of the video line 14, the data lines 12, and the inspection lines 41 can be detected based on the magnitude of the current flowing through this path.

In FIG. 5, the data line 12 on the end on the +X direction side in the drawing is referred to as a first data line 12*a*. Disconnection is caused in the midway of the first data line 12*a*. Even when the data line switch 39 is in an on state, a current does not flow from the first data line 12*a* to the inspection line 41. A disconnection defect of the data line 12 is detected based on the magnitude of the current flowing through the inspection line 41. In actuality, a feeble leakage current is generated, and hence a determination value of the current is set in consideration of the leakage current to perform determination.

The number of the data line switches 39 coupled to one inspection line 41 is 480 as calculated from an equation 1920/4=480. The data line switches 39 other than those in the first group 39*a* are in an off state, and a leakage current of one data line switch 39 is equal to or less than 1 nA. The total leakage current of one inspection line 41 is less than 1 μA. When disconnection of the data lines 12 is determined with an amperemeter provided to the data inspection terminal 41*a*, a determination value of the current is set to, for example, 10 μA. When an absorption current of 10 μA or more is detected at the data inspection terminal 41*a*, it is determined that the data lines 12 are in a conduction state. When an absorption current at the data inspection terminal 41*a* is less than 10 μA, it is determined that disconnection is caused in the data lines 12.

In the drawing, the four data lines 12 on the +X direction side are subjected to inspection. The selection circuit 4 switches the second selection lines 42 to which the second selection signal at the H level is output, subsequently from the +X direction side to the −X direction side, and all the data lines 12 are subjected to inspection.

As described above, the order of the potentials satisfies a relationship of the third high potential=the fourth high potential>the first high potential=the first low potential=the second high potential=the second low potential>the potential of the inspection signal, and hence whether disconnection is caused in the data lines 12 can be detected.

Third Exemplary Embodiment

This exemplary embodiment is different from the second exemplary embodiment in that a voltage that is applied to the detection terminal is different. Note that the matters similar to those in the second exemplary embodiment are omitted in the description.

Figure 6:
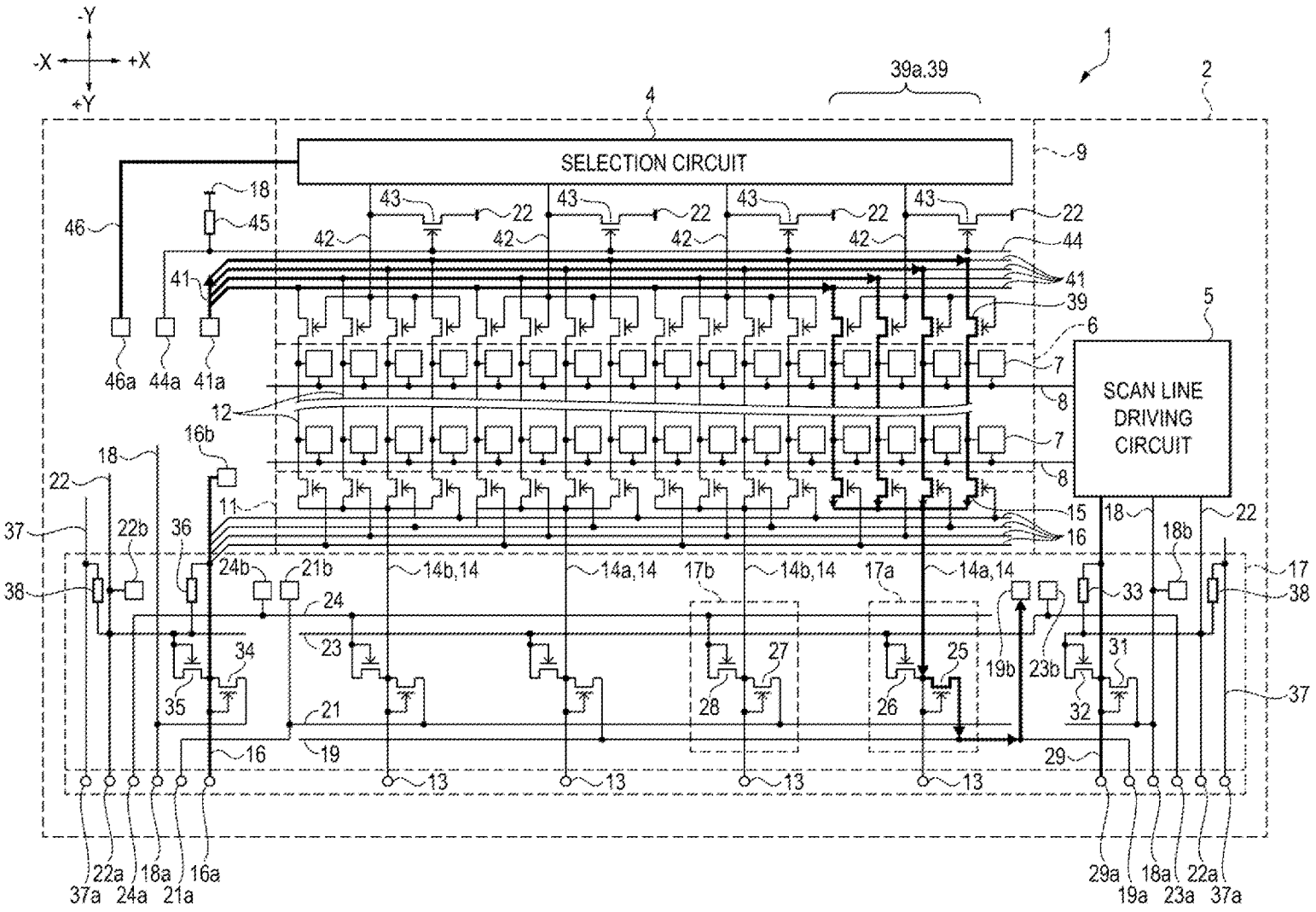
FIG. 6 is a diagram describing disconnection inspection for data lines according to a third exemplary embodiment.
Figure 7:
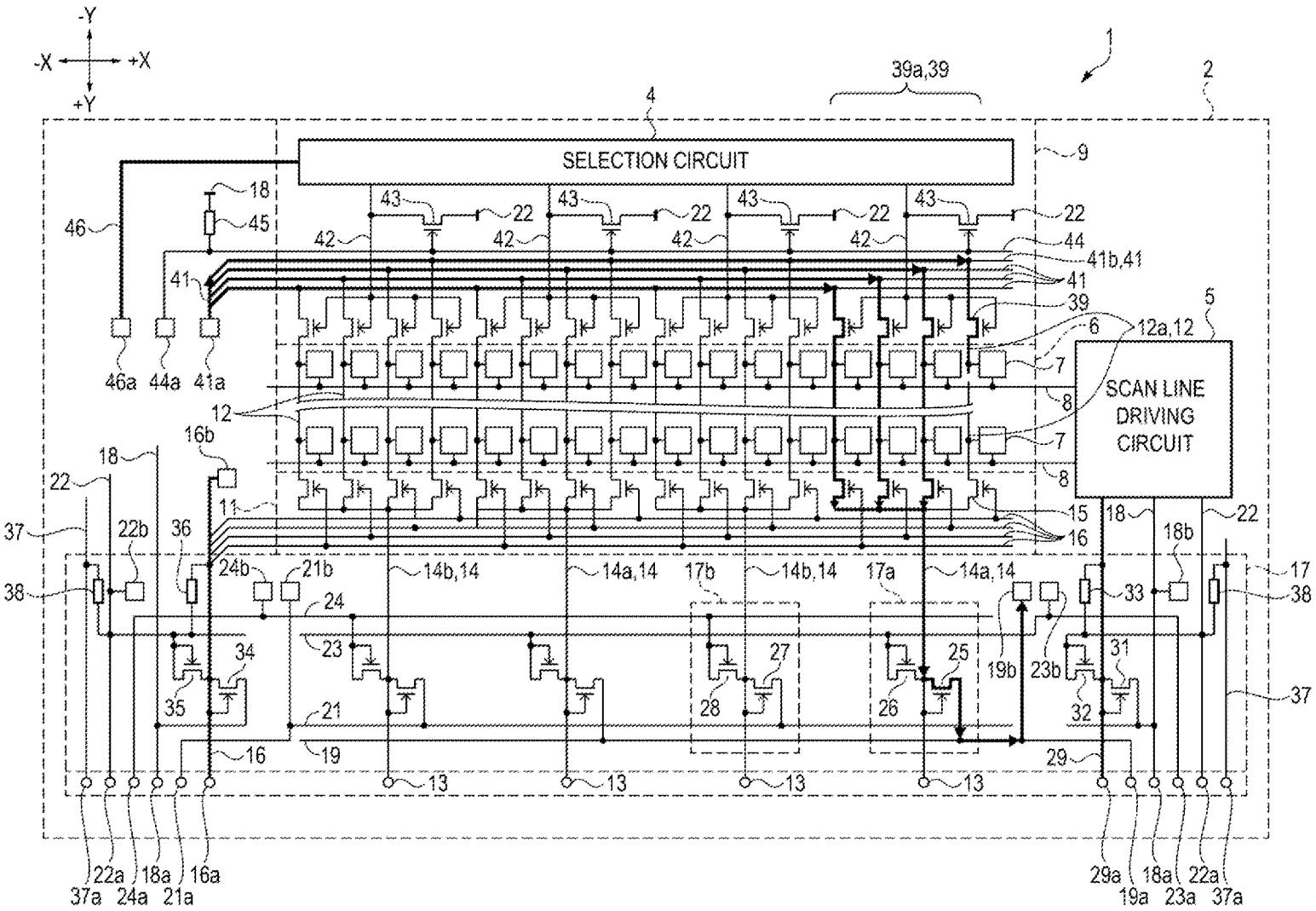
FIG. 7 is a diagram describing disconnection inspection for data lines.

FIG. 6 and FIG. 7 are diagrams describing disconnection inspection for the data lines. FIG. 6 is a diagram illustrating a flow of a current when disconnection is not caused in the data lines 12. FIG. 7 is a diagram illustrating a flow of a current when disconnection is partially caused in the data lines 12. Next, a method of inspecting disconnection of the data lines 12 is described.

In FIG. 6, the inspection signal having the equal potential is applied to the four data inspection terminals 41*a*. Unlike the second exemplary embodiment, the voltages satisfying a relationship of the third high potential=the fourth high potential>the inspection signal>the first high potential=the first low potential=the second high potential=the second low potential>the third low potential are applied to the high potential line 18, the second selection line 42, the inspection line 41, the first high potential line 19, the first low potential line 23, the second high potential line 21, the second low potential line 24, and the third low potential line 22, respectively.

In this exemplary embodiment, for example, the third high potential=15.5 V, the fourth high potential=15.5 V, the inspection signal=10 V, the first high potential=2 V, the first low potential=2 V, the second high potential=2 V, the second low potential=2 V, and the third low potential=0 V are satisfied.

A potential difference between the first high potential and the inspection signal is set larger than a total voltage drop value of a voltage drop of the first diode 25 in the electrostatic protection circuit 17, a voltage drop of the video line switch 15 in the distribution circuit 11, and a voltage drop of the data line switch 39 in the inspection circuit 9. Note that the voltage drop of the first diode 25 and the voltage drop of the third diode 27 are the same.

The voltage of the data inspection terminal 41*a* is 10 V. The voltage of the first high potential inspection terminal 19*b* is 2 V. In the drawing, the data line switches 39 in the first group 39*a* are in an on state. The video line switches 15 are also in an on state. The data line switches 39 are in an on state, and hence a current flows from the inspection lines 41 to the data lines 12.

The video line switches 15 are in an on state, and hence a current flows from the data lines 12 to the first video line 14*a*. In the electrostatic protection circuit 17, the first high potential inspection terminal 19*b* has a potential lower than that of the first video line 14*a*. Thus, a current passes from the first video line 14*a* through the first diode 25 and the first high potential line 19 and flows to the first high potential inspection terminal 19*b*. The voltage of the first low potential line 23 is 2 V, and is lower than the voltage of the first video line 14*a*. Thus, a current is less likely to flow through the second diode 26.

In FIG. 7, the data line 12, which is electrically coupled to the data line switch 39 in the first group 39*a* on the end in the +X direction, is referred to as the first data line 12*a*. Disconnection is caused in the first data line 12*a* between the data line switch 39 and the video line switch 15. Even when the video line switch 15 is an on state, a current does not flow from the first data line 12*a* to the first video line 14*a*. A disconnection defect of the data line 12 is detected based on the magnitude of the current flowing through the inspection line 41. In actuality, a feeble leakage current is generated, and hence a determination value of the current is set in consideration of the leakage current to perform determination.

When a discharge current of 10 μA or more is detected at the data inspection terminal 41*a*, it is determined that the data lines 12 are in a conduction state. When a discharge current at the data inspection terminal 41*a* is less than 10 μA, it is determined that disconnection is caused in the data lines 12. The inspection line 41 electrically coupled to the first data line 12*a* is referred to as a first inspection line 41*b*. A discharge current at the data inspection terminal 41*a* electrically coupled to the first inspection line 41*b* is less than 10 μA, and hence it can be detected that disconnection is caused in the first data line 12*a*.

As described above, the order of the potentials satisfies a relationship of the third high potential=the fourth high potential>the inspection signal>the first high potential=the first low potential=the second high potential=the second low potential>the third low potential, and hence whether disconnection is caused in the data lines 12 can be detected.

In the third exemplary embodiment, the third high potential, the fourth high potential, the first high potential, the first low potential, the second high potential, the second low potential and the potential of the inspection signal are set, and thus a current flows to the first diode 25 or the third diode 27. In the second exemplary embodiment, the third high potential, the fourth high potential, the first high potential, the first low potential, the second high potential, the second low potential, and the potential of the inspection signal are set, and thus a current flows to the second diode 26 or the fourth diode 28.

The third high potential, the fourth high potential, the first high potential, the first low potential, the second high potential, the second low potential, and the potential of the inspection signal are changed, and inspection is performed twice. With this, the diodes through which a current of the electrostatic protection circuit 17 flows can be changed. Specifically, disconnection of a path flowing through each of the first diode 25 to the fourth diode 28 can be detected. Conduction inspection for the electrostatic protection circuit 17 can be performed, and hence the liquid crystal panel 2 that is highly reliable can be manufactured.

Fourth Exemplary Embodiment

This exemplary embodiment is different from the first exemplary embodiment in that arrangement of the first high potential terminal 19*a* and the first low potential terminal 23*a*, and further, arrangement of the second high potential terminal 21*a* and the second low potential terminal 24*a* are different. Note that, the descriptions for the points identical to those of the first exemplary embodiment are omitted.

Figure 8:
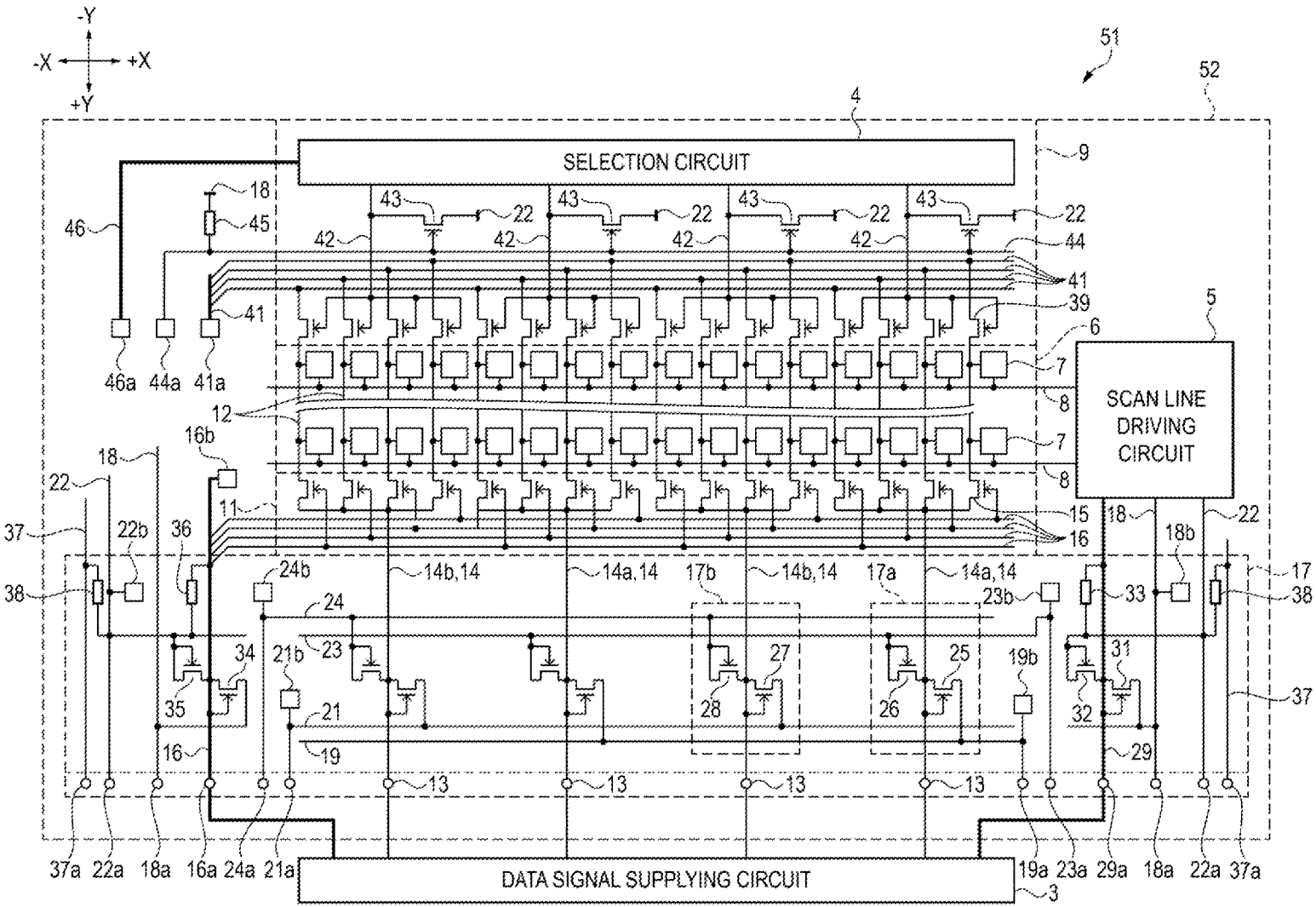
FIG. 8 is a diagram describing of positions of wiring terminals according to a fourth exemplary embodiment.

FIG. 8 is a diagram describing positions of wiring terminals. As illustrated in FIG. 8, on a liquid crystal panel 52 included in an electro-optical device 51, terminals are arrayed on the +Y direction side. On the +X direction side, the terminals are arrayed in the order of the common electrode terminal 37*a*, the low potential terminal 22*a*, the high potential terminal 18*a*, the scan control terminal 29*a*, the first low potential terminal 23*a*, the first high potential terminal 19*a*, and the video terminal 13. On the −X direction side, the terminals are arrayed in the order of the common electrode terminal 37*a*, the low potential terminal 22*a*, the high potential terminal 18*a*, the selection terminal 16*a*, the second low potential terminal 24*a*, the second high potential terminal 21*a*, and the video terminal 13. When the terminals are arrayed in this manner, the high potential line 18 and the first low potential line 23 do not cross each other. The high potential line 18 and the second low potential line 24 do not cross each other.

The first high potential inspection terminal 19*b* and the second high potential inspection terminal 21*b* are arranged on the +Y direction side with respect to the first low potential line 23. When the inspection terminals are arranged in this manner, the second high potential line 21 and the second low potential line 24 do not cross each other. The first high potential line 19 and the first low potential line 23 do not cross each other.

After inspection for the wiring lines is completed, the first high potential, the second high potential, and the third high potential are set to the same potential. The high potential line 18, the first high potential line 19, and the voltage of the second high potential line 21 have the same potential. The first low potential, the second low potential, and the third low potential are set to the same potential. The low potential line 22, the first low potential line 23, and the second low potential line 24 have the same potential.

The first low potential terminal 23*a* and the first high potential terminal 19*a* are arranged close to the video terminal 13, and the second low potential terminal 24*a* and the second high potential terminal 21*a* are arranged close to the video terminal 13. Thus, within the liquid crystal panel 52, crossing between the high potential line 18 and the first low potential line 23 can be reduced. Similarly, crossing between the high potential line 18 and the second low potential line 24 can be reduced. Further, crossing between the second high potential line 21 and the second low potential line 24 can be reduced. Further, the first high potential line 19 and the first low potential line 23 can be reduced. As a result, degradation of a yield due to a short circuit between the wiring lines can be suppressed.

Figure 9:
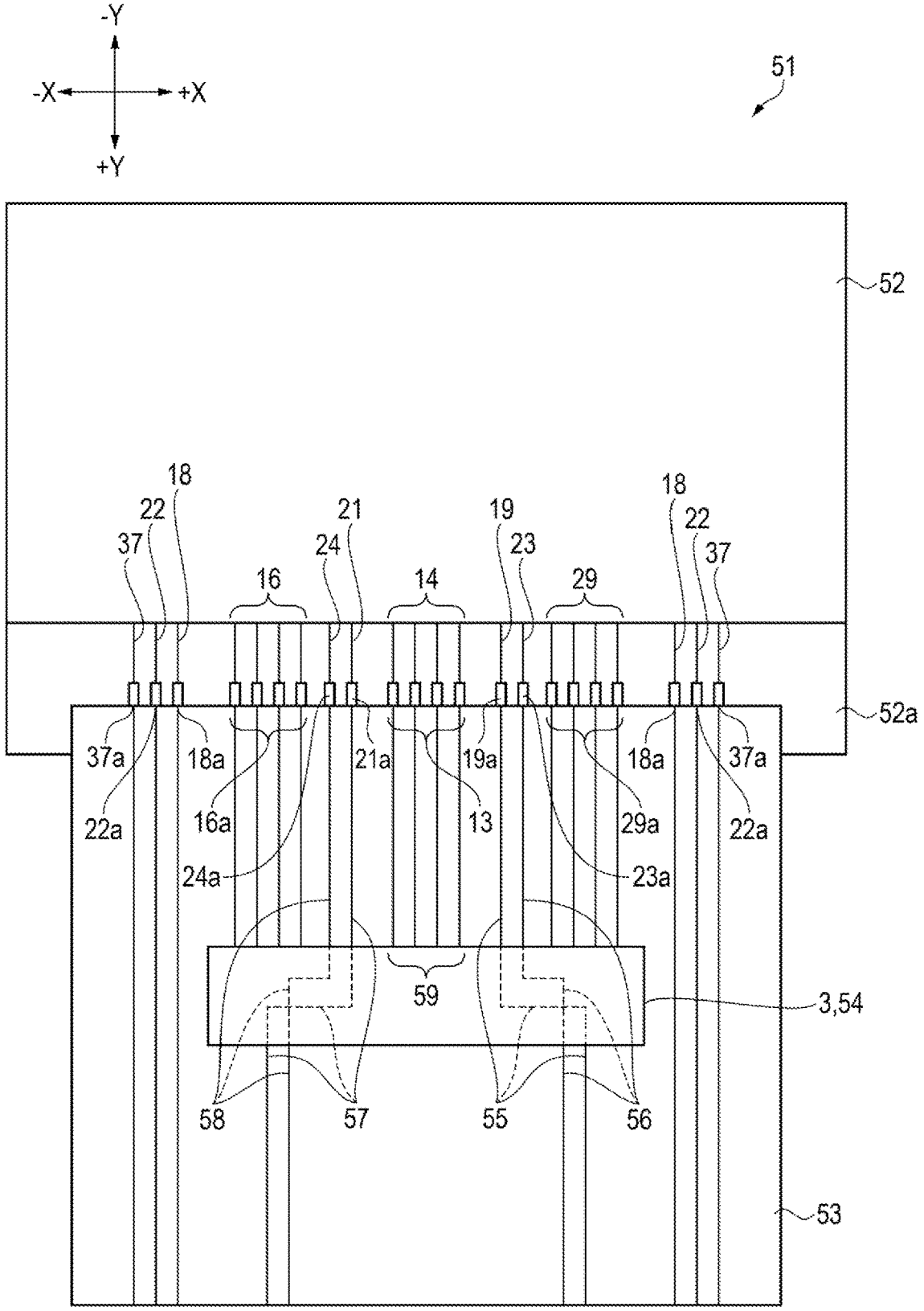
FIG. 9 is a schematic diagram describing wiring lines on a flexible wiring substrate coupled to a liquid crystal panel.

FIG. 9 is a schematic diagram describing wiring lines on a flexible wiring substrate coupled to a liquid crystal panel. As illustrated in FIG. 9, the liquid crystal panel 52 includes an element substrate 52*a* as a substrate, and a flexible wiring substrate 53 as a flexible printed wiring substrate is coupled to the element substrate 52*a*. A semiconductor chip on which the data signal supplying circuit 3 is formed is mounted on the flexible wiring substrate 53.

On the element substrate 52*a*, the first high potential line 19, the first low potential line 23, the second high potential line 21, the second low potential line 24, the high potential line 18, and the low potential line 22 are arranged. The flexible wiring substrate 53 is electrically coupled to the first high potential line 19, the first low potential line 23, the second high potential line 21, the second low potential line 24, the high potential line 18, and the low potential line 22.

The flexible wiring substrate 53 includes a drive IC 54, a first wiring line 55, a second wiring line 56, a third wiring line 57, and a fourth wiring line 58. The data signal supplying circuit 3 is formed in the drive IC 54. The first wiring line 55 is electrically coupled to the first high potential line 19. The second wiring line 56 is electrically coupled to the first low potential line 23. The third wiring line 57 is electrically coupled to the second high potential line 21. The fourth wiring line 58 is electrically coupled to the second low potential line 24.

The first wiring line 55 and the second wiring line 56 cross each other inside the drive IC 54. The third wiring line 57 and the fourth wiring line 58 cross each other inside the drive IC 54. In the drive IC 54, the first wiring line 55 and the second wiring line 56 overlap each other through intermediation of an insulating film. With this, the first wiring line 55 and the second wiring line 56 can easily cross each other. Similarly, in the drive IC 54, the third wiring line 57 and the fourth wiring line 58 overlap each other through intermediation of an insulating film. With this, the third wiring line 57 and the fourth wiring line 58 can easily cross each other. In this manner, the first wiring line 55 coupled to the first high potential line 19 can be arranged adjacent to the high potential line 18, which supplies the same potential, on the flexible wiring substrate 53. Similarly, the third wiring line 57 coupled to the second high potential line 21 can be arranged adjacent to the high potential line 18, which supplies the same potential, on the flexible wiring substrate 53. The wiring lines having the equal potentials are adjacent to each other, and hence the wiring pattern on the flexible wiring substrate 53 mounted to the element substrate 52*a* can be simplified.

Note that, on the element substrate 52*a*, the arrangement relationship between the first high potential terminal 19*a* and the first low potential terminal 23*a* may be reversed. In this case, the first wiring line 55 coupled to the first high potential line 19 can be arranged adjacent to the high potential line 18, which supplies the same potential, on the flexible wiring substrate 53 without causing the first wiring line 55 and the second wiring line 56 to cross each other inside the drive IC 54. Similarly, the arrangement relationship between the second high potential terminal 21*a* and the second low potential terminal 24*a* may be reversed. In this case, the third wiring line 57 coupled to the second high potential line 21 can be arranged adjacent to the high potential line 18, which supplies the same potential, on the flexible wiring substrate 53 without causing the third wiring line 57 and the fourth wiring line 58 to cross each other inside the drive IC 54. In either case, the first wiring line 55, the second wiring line 56, the third wiring line 57, and the fourth wiring line 58 that extend through the drive IC 54 are provided, and hence arrangement of the first high potential terminal 19*a*, the first low potential terminal 23*a*, the second high potential terminal 21*a*, and the second low potential terminal 24*a* on the element substrate 52*a* can be adjusted easily. Particularly, those terminals can be arranged close to the video terminal 13, and hence the crossing parts in the liquid crystal panel 52 can be reduced. Further, the wiring lines having the same potentials can be adjacent to each other on the flexible wiring substrate 53, and hence the wiring pattern on the flexible wiring substrate 53 can be simplified.

Wiring lines electrically coupled to the video lines 14 are video coupling lines 59. In the drawing, the number of the video lines 14, the number of the video terminals 13, and the number of the video coupling lines 59, which are illustrated in an omission manner, are only four. The first wiring line 55 and the second wiring line 56 are arranged on the +X direction side of the video coupling lines 59. The third wiring line 57 and the fourth wiring line 58 are arranged on the −X direction side of the video coupling lines 59. With this arrangement, in the drive IC 54, the video coupling lines 59 can be arranged without crossing the first wiring line 55 to the fourth wiring line 58.

Note that, when the wiring lines can easily be caused to cross each other on the flexible wiring substrate 53, the wiring lines may be caused to cross each other through use of a jumper wire or the like on the flexible wiring substrate 53, not inside the drive IC 54.

Fifth Exemplary Embodiment

This exemplary embodiment is different from the first exemplary embodiment in that an electrostatic protection circuit that performs discharging to the high potential line 18 and the low potential line 22 is added. Note that, the descriptions for the points identical to those of the first exemplary embodiment are omitted.

Figure 10:
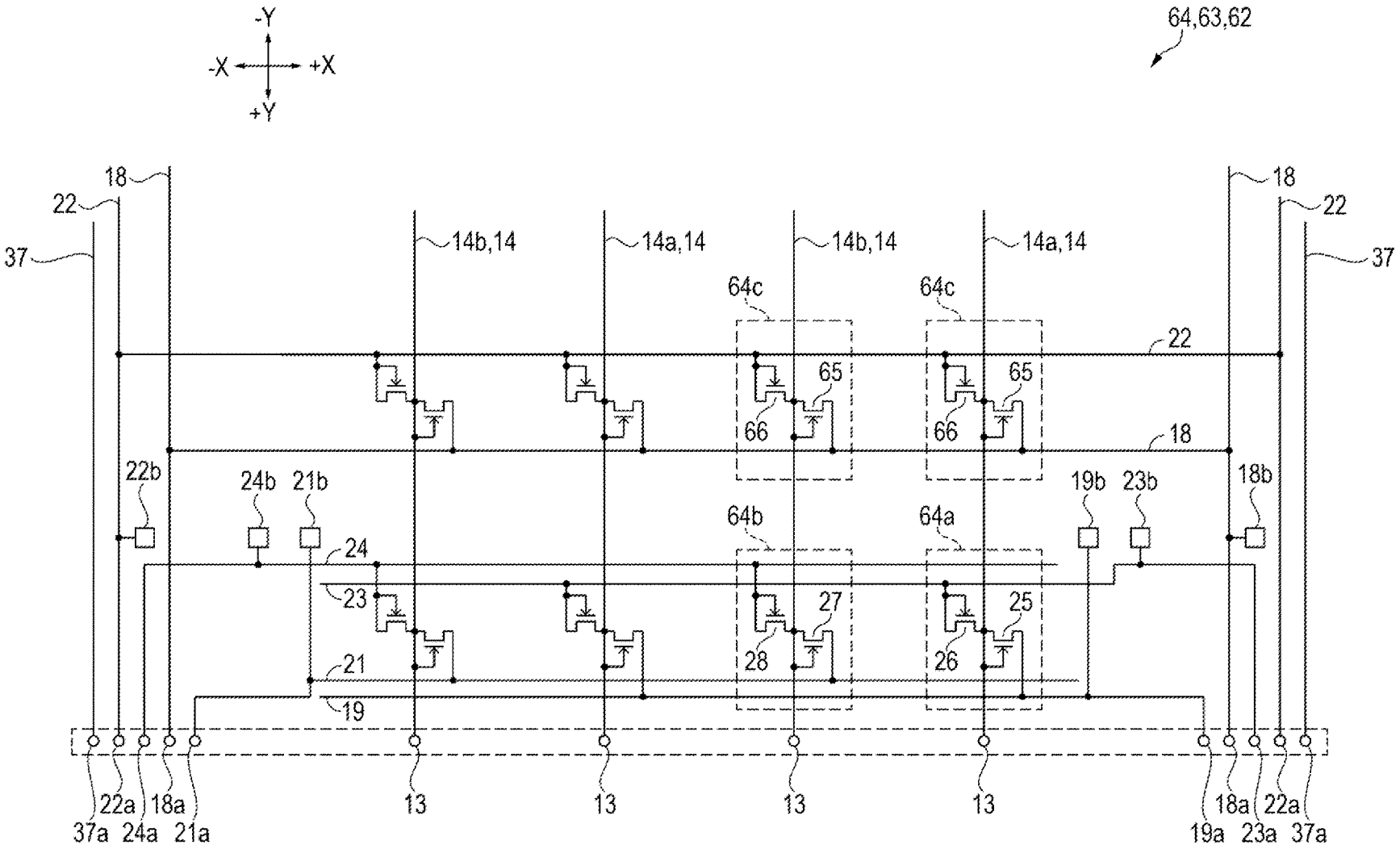
FIG. 10 is a diagram describing an electrostatic protection circuit according to a fifth exemplary embodiment.

FIG. 10 is a diagram describing an electrostatic protection circuit. As illustrated in FIG. 10, an electro-optical device 62 includes a liquid crystal panel 63, and the liquid crystal panel 63 includes an electrostatic protection circuit 64. The electrostatic protection circuit 64 includes a first electrostatic protection circuit 64*a*, a second electrostatic protection circuit 64*b*, and third electrostatic protection circuits 64*c*. Note that, in the drawing, an electrostatic protection circuit for the scan control line 29 and the first selection line 16 is omitted.

The first electrostatic protection circuit 64*a* and the second electrostatic protection circuit 64*b* are the same circuits as the first electrostatic protection circuit 17*a* and the second electrostatic protection circuit 17*b* in the first exemplary embodiment, respectively. The first electrostatic protection circuit 64*a* discharges static electricity of the first video line 14*a* to the first low potential line 23 or the first high potential line 19. The second electrostatic protection circuit 64*b* discharges static electricity of the second video line 14*b* to the second low potential line 24 or the second high potential line 21. The third electrostatic protection circuits 64*c* discharge static electricity of the first video line 14*a* and the second video line 14*b* to the low potential line 22 or the high potential line 18.

The first video line 14*a* and the second video line 14*b* are electrically coupled to the high potential line 18 via fifth diodes 65. In other words, the high potential line 18 is electrically coupled to the first video line 14*a* and the second video line 14*b* via the fifth diodes 65. An anode of the fifth diode 65 is electrically coupled to the first video line 14*a* or the second video line 14*b*, and a cathode of the fifth diode 65 is electrically coupled to the high potential line 18. A potential of the high potential line 18 is set to a potential higher than that of the data signal. When static electricity causes the first video line 14*a* or the second video line 14*b* to have a voltage higher than that of the high potential line 18, a current passes through the fifth diodes 65 and flows to the high potential line 18.

The first video line 14*a* and the second video line 14*b* are electrically coupled to the low potential line 22 via sixth diodes 66. In other words, the low potential line 22 is electrically coupled to the first video line 14*a* or the second video line 14*b* via the sixth diode 66. A cathode of the sixth diode 66 is electrically coupled to the first video line 14*a* or the second video line 14*b*, and an anode of the sixth diode 66 is electrically coupled to the low potential line 22. A potential of the low potential line 22 is set to a potential lower than that of the data signal. When static electricity causes the first video line 14*a* or the second video line 14*b* to have a voltage lower than that of the low potential line 22, a current passes through the sixth diode 66 and flows to the low potential line 22. In this configuration, two systems of the electrostatic protection circuits are arranged. In the configuration, destinations to which the electrostatic protection circuits perform discharging are separated, and paths that are diode-coupled for inspection and allow a current to flow therethrough are provided.

For example, a channel width W of an N-type transistor of the electrostatic protection circuit 64, which is required for normal driving, is set to 300 μm. 250 μm is allocated to a channel width W of the third electrostatic protection circuit 64*c* that performs discharging to the high potential line 18 or the low potential line 22. 50 μm is allocated to channel widths W of the first electrostatic protection circuit 64*a* and the second electrostatic protection circuit 64*b* that perform discharging to the first high potential line 19, the second high potential line 21, the first low potential line 23, and the second low potential line 24. As compared to a configuration in which all the channel widths W of the electrostatic protection circuit 64 are allocated for inspection, a current flowing for inspection is small when the same voltage is set.

In a case where a short circuit is caused between the image signal lines and a current flows, when the current is large, a case where a wiring line is fused and a short-circuit current is zero may be conceived. In this case, a defect cannot be detected. With the circuits in this exemplary embodiment, a short-circuit current can be reduced, and hence fusing of the wiring lines can be suppressed. Further, a risk that a defect cannot be detected can be lowered. Further, a degree of freedom of voltage setting for inspection can be higher. Moreover, the third electrostatic protection circuits 64*c* that perform discharging to the high potential line 18 and the low potential line 22 on the liquid crystal panel 63 are always operated, and hence effective protection from static electricity entering from the video terminals 13 can be achieved.

Note that it is suitable that the first electrostatic protection circuit 64*a* and the second electrostatic protection circuit 64*b* be provided on the terminal side being the +Y direction side with respect to the third electrostatic protection circuits 64*c*. When the first electrostatic protection circuit 64*a* and the second electrostatic protection circuit 64*b* are arranged on the terminal side, a coupling inspection range for the video lines 14 can be increased.

Sixth Exemplary Embodiment

This exemplary embodiment is different from the first exemplary embodiment in that the first diode 25 and the third diode 27 are changed to diodes formed of P-type channel transistors. Note that, the descriptions for the points identical to those of the first exemplary embodiment are omitted.

Figure 11:
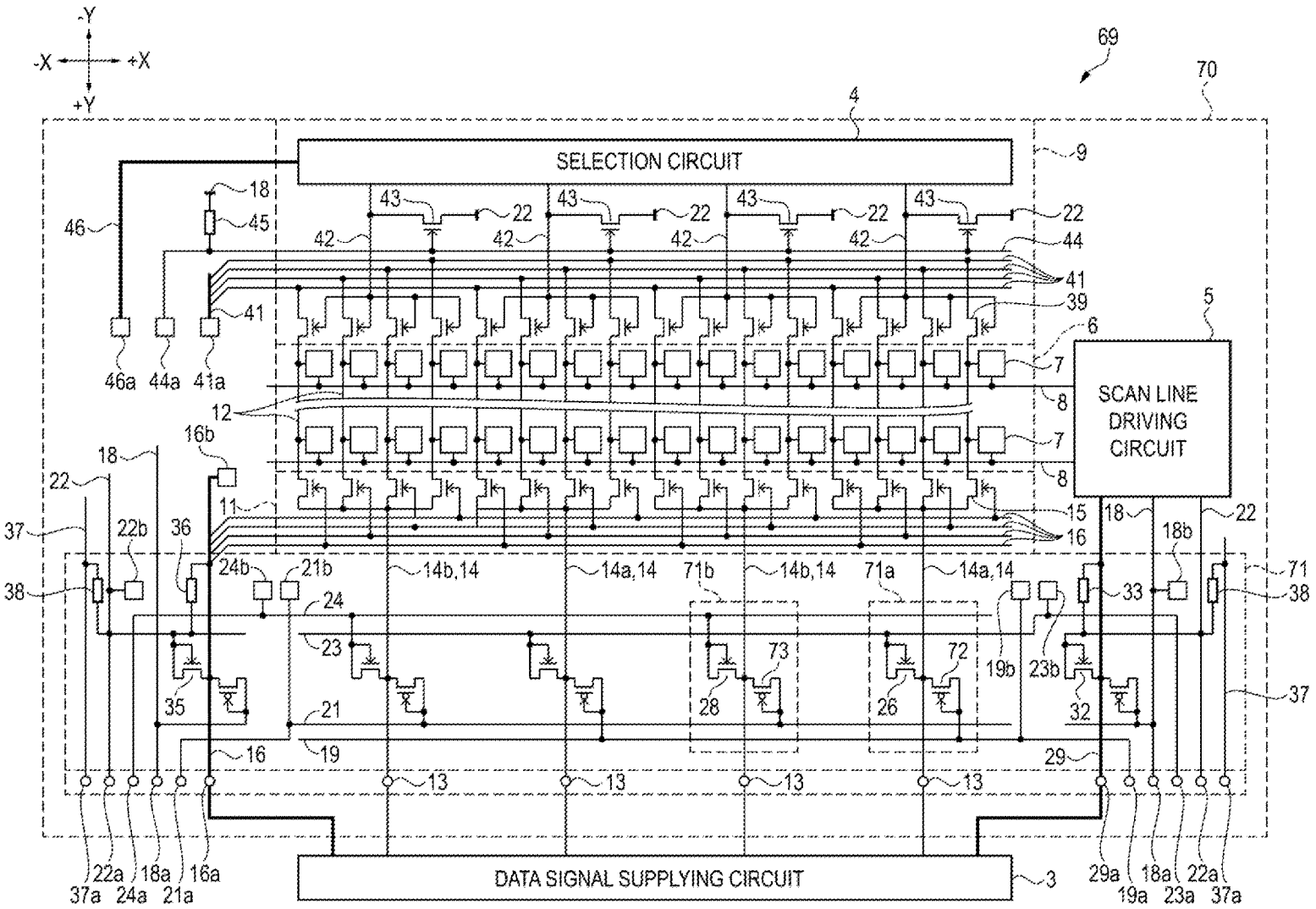
FIG. 11 is a diagram describing an electrostatic protection circuit according to a sixth exemplary embodiment.

FIG. 11 is a diagram describing an electrostatic protection circuit. As illustrated in FIG. 11, a liquid crystal panel 70 included in an electro-optical device 69 includes an electrostatic protection circuit 71. The electrostatic protection circuit 71 includes a first electrostatic protection circuit 71*a* and a second electrostatic protection circuit 71*b*. The electrostatic protection circuit 71, the first electrostatic protection circuit 71*a*, the second electrostatic protection circuit 71*b* have the same functions as the electrostatic protection circuit 17, the first electrostatic protection circuit 17*a*, the second electrostatic protection circuit 17*b* in the first exemplary embodiment, respectively.

In the first electrostatic protection circuit 71*a*, the first high potential line 19 and the first video line 14*a* are electrically coupled to each other via a first diode 72. In other words, the first high potential line 19 is electrically coupled to the first video line 14*a* via the first diode 72. An anode of the first diode 72 is electrically coupled to the first video line 14*a*, and a cathode of the first diode 72 is electrically coupled to the first high potential line 19. When static electricity causes the first video line 14*a* to have a voltage higher than that of the first high potential line 19, a current passes through the first diode 72 and flows to the first high potential line 19. The first low potential line 23 and the first video line 14*a* are electrically coupled to each other via the second diode 26.

In the second electrostatic protection circuit 71*b*, the second high potential line 21 and the second video line 14*b* are electrically coupled to each other via a third diode 73. In other words, the second high potential line 21 is electrically coupled to the second video line 14*b* via the third diode 73. An anode of the third diode 73 is electrically coupled to the second video line 14*b*, and a cathode of the third diode 73 is electrically coupled to the second high potential line 21. When static electricity causes the second video line 14*b* to have a voltage higher than that of the second high potential line 21, a current passes through the third diode 73 and flows to the second high potential line 21. The second low potential line 24 and the second video line 14*b* are electrically coupled to each other via the fourth diode 28.

The first diode 72 and the third diode 73 are formed by diode-coupling P-type channel transistors.

When a short circuit is caused between the first video line 14*a* and the second video line 14*b*, the second diode 26 and the third diode 73 are coupled in series. A threshold value of the diode-coupled P-type transistors is slightly larger than a threshold value of the diode-coupled N-type transistors. Thus, a voltage drop of the circuit in which the second diode 26 and the third diode 73 are coupled in series is slightly larger than that in the first exemplary embodiment. In this exemplary embodiment, for example, similarly in the first exemplary embodiment, the third high potential=15.5 V, the first high potential=14.5 V, the first low potential=10.5 V, the second high potential=5.5 V, the second low potential=1 V, and the third low potential=0 V are satisfied. A potential difference between the first low potential line 23 and the second high potential line 21 is 5 V as expressed with an equation 10.5-5.5=5. When a short circuit is caused between the first video line 14*a* and the second video line 14*b*, a current flows from the first low potential line 23 to the second high potential line 21. Thus, a short circuit between the first video line 14*a* and the second video line 14*b* can be detected.

The P-type transistor has a threshold value voltage that is slightly higher than that of the N-type transistor. The first exemplary embodiment is preferred in view of a degree of freedom of various voltage adjustment ranges for inspection.

Seventh Exemplary Embodiment

This exemplary embodiment is different from the second exemplary embodiment in that the first high potential line 19 and the second high potential line 21 are electrically coupled to each other. Further, the first low potential line 23 and the second low potential line 24 are electrically coupled to each other. Note that the matters similar to those in the second exemplary embodiment are omitted in the description.

Figure 12:
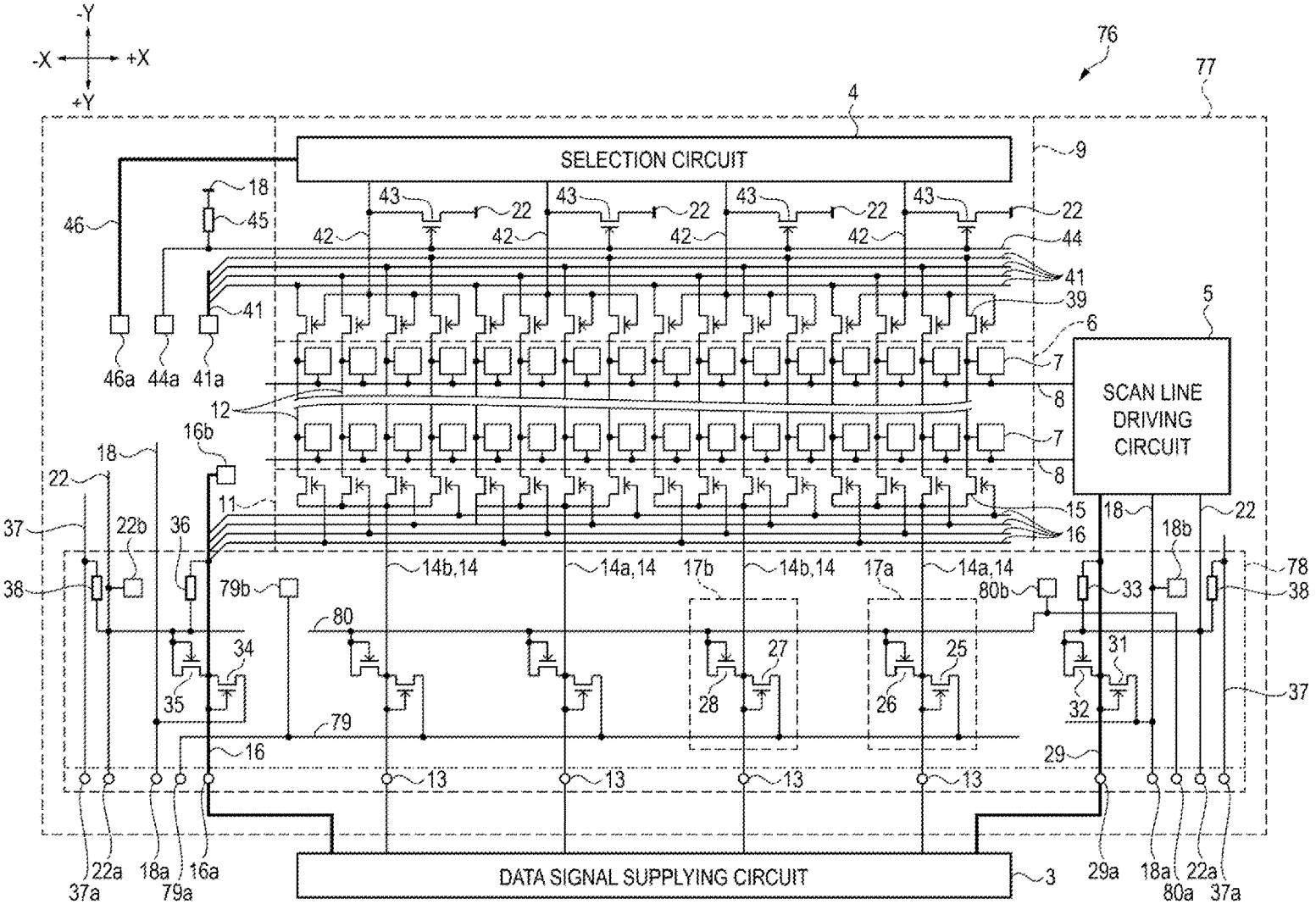
FIG. 12 is a diagram describing an electrostatic protection circuit according to a seventh exemplary embodiment.

FIG. 12 is a diagram describing an electrostatic protection circuit. As illustrated in FIG. 12, a liquid crystal panel 77 included in an electro-optical device 76 includes an electrostatic protection circuit 78. In the electrostatic protection circuit 78, the high potential line 18, the low potential line 22, a first high potential line 79, and a first low potential line 80 to which a predetermined voltage is supplied are arranged. The high potential line 18 and the low potential line 22 are electrically separated from the first high potential line 79 and the first low potential line 80, respectively. The first high potential line 79 corresponds to a wiring line obtained by electrically coupling the first high potential line 19 and the second high potential line 21 in the first exemplary embodiment to each other. The first low potential line 80 corresponds to a wiring line obtained by electrically coupling the first low potential line 23 and the second low potential line 24 in the first exemplary embodiment to each other.

A first high potential terminal 79*a* and a first high potential inspection terminal 79*b* are electrically coupled to the first high potential line 79. A first low potential terminal 80*a* and a first low potential inspection terminal 80*b* are electrically coupled to the first low potential line 80.

A potential of the first high potential line 79 is set as the first high potential, and a potential of the first low potential line 80 is set as the first low potential. Similarly in the second exemplary embodiment, the third high potential=15.5 V, the fourth high potential=15.5 V, the first high potential=10 V, the first low potential=10 V, the inspection signal=2 V, and the third low potential=0 V are satisfied.

Similarly to the second exemplary embodiment, the order of the potentials satisfies a relationship of the third high potential=the fourth high potential>the first high potential=the first low potential>the inspection signal>the third low potential, and hence whether disconnection is caused in the data lines 12 and the video lines 14 can be detected. Detection for a short circuit between the first video line 14*a* and the second video line 14*b* cannot be performed. As compared to the second exemplary embodiment, the wiring lines can be simplified because the second high potential line 21 and the second low potential line 24 can be omitted. This is applicable when an interval between the first video line 14*a* and the second video line 14*b* is wide and a short circuit is less likely to be caused.

Eighth Exemplary Embodiment

In this exemplary embodiment, an electronic apparatus using any one of the electro-optical device 1, the electro-optical device 51, the electro-optical device 62, the electro-optical device 69, and the electro-optical device 76 according to the above-mentioned exemplary embodiments is described.

Figure 13:
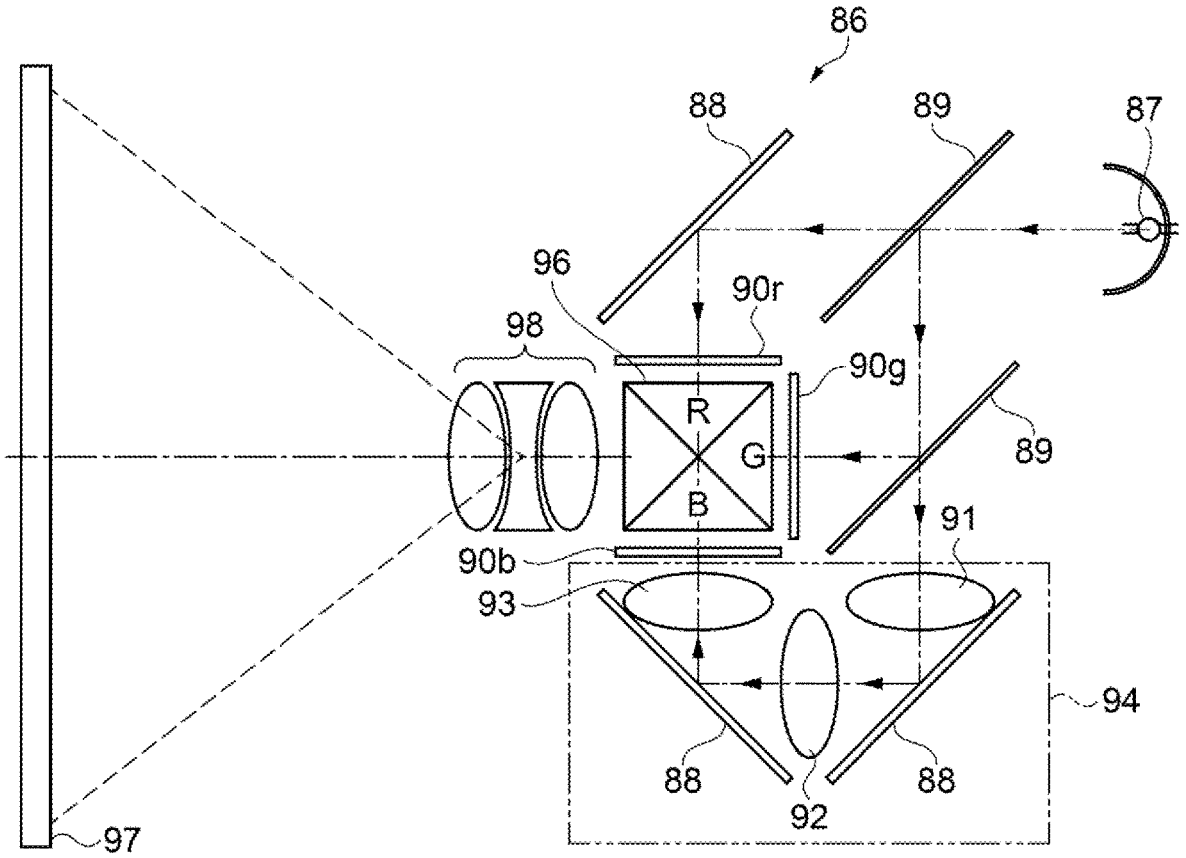
FIG. 13 is a configuration diagram illustrating a configuration of a projection-type display apparatus using an electro-optical device according to an eighth exemplary embodiment.

FIG. 13 is a configuration diagram illustrating a configuration of a projection-type display apparatus using an electro-optical device. As illustrated in FIG. 13, a lamp unit 87 including a white light source such as a halogen lamp is provided inside a projection-type display apparatus 86 being an electronic apparatus. Projection light emitted from the lamp unit 87 is split into three primary colors of red, green, and blue by three mirrors 88 and two dichroic mirrors 89 arranged inside.

The split projection light of the three primary colors is guided to a red light valve 90*r*, a green light valve 90*g*, and a blue light valve 90*b* that respectively correspond to the primary colors. Note that, since the blue light has a long optical path as compared to the other red light and green light, the blue light is guided via a relay lens system 94 including an incidence lens 91, a relay lens 92, and an emission lens 93 in order to prevent a loss of the blue light.

The red light valve 90*r*, the green light valve 90*g*, and the blue light valve 90*b* are coupled to an upper circuit in the projection-type display apparatus 86. An image signal that specifies a gray scale level of each of primary color components of red color, green color, and blue color is supplied from an external upper circuit, is processed in the upper circuit in the projection-type display apparatus 86, and drives each of the red light valve 90*r*, the green light valve 90*g*, and the blue light valve 90*b*. The light modulated by each of the red light valve 90*r*, the green light valve 90*g*, and the blue light valve 90*b* enters a dichroic prism 96 from three directions. Then, at the dichroic prism 96, the ref light and the blue light are reflected at 90 degrees, and the green light passes therethrough. Thus, after the images of the respective primary colors are synthesized, a color image is projected on a screen 97 by a projection lens group 98.

Any one of the electro-optical device 1, the electro-optical device 51, the electro-optical device 62, the electro-optical device 69, and the electro-optical device 76 is used for the red light valve 90*r*, the green light valve 90*g*, and the blue light valve 90*b*.

Each of the electro-optical device 1, the electro-optical device 51, the electro-optical device 62, the electro-optical device 69, the electro-optical device 76 is an optical device capable of inspecting the video lines 14 and the data lines 12 with a simple terminal configuration even when the number of the video lines 14 and the number of the data lines 12 are large. Therefore, the projection-type display apparatus 86 can be an apparatus including any one of the electro-optical device 1, the electro-optical device 51, the electro-optical device 62, the electro-optical device 69, and the electro-optical device 76 that are capable of inspecting the video lines 14 and the data lines 12 with a simple terminal configuration.

Modification 1

The electronic apparatus including the electro-optical device 1, the electro-optical device 51, the electro-optical device 62, the electro-optical device 69, or the electro-optical device 76 is not limited to the projection-type display apparatus 86 according to the above-mentioned exemplary embodiment. Examples may include electronic apparatus such as a projection-type head up display, a direct-view-type head mounted display, a personal computer, a digital still camera, and a liquid crystal television.

Modification 2

In the first exemplary embodiment and the second exemplary embodiment, the potential lines being discharging destinations of the first electrostatic protection circuit 17*a* and the second electrostatic protection circuit 17*b* that are provided to the video lines 14 are not inhibited from functioning as potential lines of electrostatic protection circuits for other signals. During inspection for a short circuit between the video lines 14 and conduction inspection for the data lines 12, the scan line driving circuit 5 is in a resting state. For example, the electrostatic protection circuit 17 may be modified to include an electrostatic protection circuit for a start pulse signal of the scan line driving circuit 5, which is transmitted through the scan control line 29. In addition to the start pulse signal, the electrostatic protection circuit 17 may further be modified to include an electrostatic protection circuit for an output control signal that controls selection of gate lines by calculating output of a shift resistor and a logical AND of the scan line driving circuit 5, which is transmitted through the scan control line 29.

Modification 3

Figure 14:
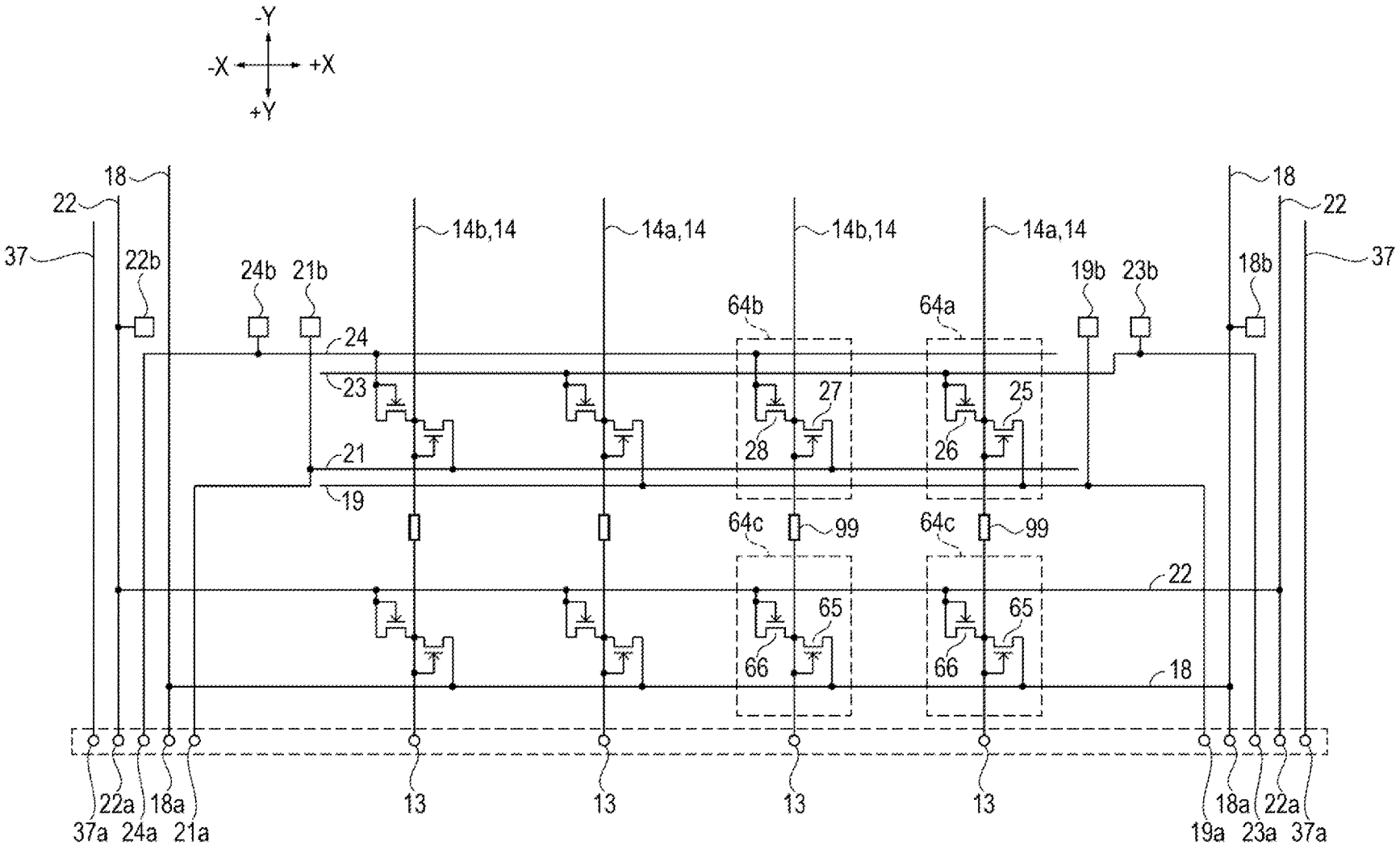
FIG. 14 is a diagram describing an electrostatic protection circuit according to a modification example.

FIG. 14 is a diagram describing an electrostatic protection circuit. In the fifth exemplary embodiment, the first electrostatic protection circuit 64*a* and the second electrostatic protection circuit 64*b* are provided on the +Y direction side with respect to the third electrostatic protection circuits 64*c*. As illustrated in FIG. 14, the first electrostatic protection circuit 64*a* and the second electrostatic protection circuit 64*b* may be provided on the −Y direction side with respect to the third electrostatic protection circuits 64*c*. In this case, an example of focusing on protection from static electricity entering from the video terminal 13 is given. In such case, a resistive element 99 may be provided to the video line 14 that couples the first electrostatic protection circuit 64*a* and the second electrostatic protection circuit 64*b*, and the third electrostatic protection circuits 64*c* to one another, and entry of static electricity to an inner circuit side may be mitigated.

Contents derived from the exemplary embodiments are described below.

An electro-optical device includes a first video line and a second video line that is adjacent to each other, a first high potential line that is electrically connected with the first video line via a first diode, a first low potential line that is electrically connected with the first video line via a second diode, a first mounting terminal and a first inspection terminal that are electrically connected with the first high potential line, a second mounting terminal and a second inspection terminal that are electrically connected with the first low potential line, a second high potential line that is electrically connected with the second video line via a third diode, a second low potential line that is electrically connected with the second video line via a fourth diode, a third mounting terminal and a third inspection terminal that are electrically connected with the second high potential line, and a fourth mounting terminal and a fourth inspection terminal that are electrically connected with the second low potential line, the first diode having an anode electrically connected with the first video line, the second diode having a cathode electrically connected with the first video line, the third diode having an anode electrically connected with the second video line, and the fourth diode having a cathode electrically connected with the second video line.

With this configuration, when a signal having a voltage higher than that of the first high potential line is input to the first video line, a current flows from the first video line to the first high potential line via the first diode. When a signal having a voltage lower than that of the first low potential line is input to the first video line, a current flows from the first low potential line to the first video line via the second diode. When a signal having a voltage higher than that of the second high potential line is input to the second video line, a current flows from the second video line to the second high potential line via the third diode. When a signal having a voltage lower than that of the second low potential line is input to the second video line, a current flows from the second low potential line to the second video line via the fourth diode. The first diode to the fourth diode function as protection circuits that cause the potentials of the first video line and the second video line to fall within a predetermined range.

The first high potential line, the first low potential line, the second high potential line, and the second low potential line are electrically coupled to the first inspection terminal, the second inspection terminal, the third inspection terminal, and the fourth inspection terminal, respectively. A voltage is applied to each of the terminals via a probe, and a current is measured.

The voltages applied to the first high potential line, the first low potential line, the second high potential line, and the second low potential line are referred to as a first high potential, a first low potential, a second high potential, and a second low potential, respectively. The voltages satisfying a relationship of the first high potential≥the first low potential>the second high potential≥the second low potential are applied to the first inspection terminal, the second inspection terminal, the third inspection terminal, and the fourth inspection terminal, respectively.

When a short circuit is caused between the first video line and the second video line, a current flows from the first low potential line to the second high potential line. Specifically, a current flows subsequently through the first low potential line, the second diode, the first video line, the short circuit, the second video line, the third diode, and the second high potential line. A current flowing between the second inspection terminal and the third inspection terminal is detected, and the short circuit between the first video line and the second video line is detected.

For short-circuit inspection, a method of arranging an inspection terminal to each of the first video lines and the second video lines is conceivable. In this method, a large number of terminals are required, and hence arrangement of the terminals with which a probe is brought into contact is difficult. As compared to this method, in this electro-optical device, the first inspection terminal, the second inspection terminal, the third inspection terminal, and the fourth inspection terminal are provided, and hence short-circuit inspection between the first video line and the second video line can be performed. Thus, even when the number of the first video lines and the number of the second video lines are large, inspection with excellent reliability can be performed without hindering size reduction.

The electro-optical device described above may further include a scan line driving circuit configured to transmit a scan signal, a scan control line configured to supply a scan data signal to the scan line driving circuit, a third high potential line electrically coupled to the scan control line via a fifth diode, and a third low potential line electrically coupled to the scan control line via a sixth diode, wherein the fifth diode may have an anode electrically coupled to the scan control line, the sixth diode may have a cathode electrically coupled to the scan control line, and the third high potential line and the third low potential line may be electrically separated from the first high potential line, the first low potential line, the second high potential line, and the second low potential line.

With this configuration, the scan data signal is supplied from the scan control line to the scan line driving circuit. When a signal having a voltage higher than that of the third high potential line is input to the scan control line, a current flows from the scan control line to the third high potential line via the fifth diode. When a signal having a voltage lower than that of the third low potential line is input to the scan control line, a current flows from the third low potential line to the scan control line via the sixth diode. The fifth diode and the sixth diode function as protection circuits that cause the potential of the scan control line to fall within a predetermined range.

The third high potential line and the third low potential line are electrically separated from the first high potential line, the first low potential line, the second high potential line, and the second low potential line. Thus, short-circuit inspection between the first video line and the second video line can be performed without hindering an operation of the scan line driving circuit.

The electro-optical device described above may further include a fifth mounting terminal and a fifth inspection terminal that are electrically coupled to the third high potential line, and a sixth mounting terminal and a sixth inspection terminal that are electrically coupled to the third low potential line, wherein the fifth mounting terminal may be arranged adjacent to the first mounting terminal and the third mounting terminal, and the sixth mounting terminal may be arranged adjacent to the second mounting terminal and the fourth mounting terminal.

With this configuration, the fifth mounting terminal is arranged adjacent to the first mounting terminal and the third mounting terminal. The sixth mounting terminal is arranged adjacent to the second mounting terminal and the fourth mounting terminal. After inspection is completed, a voltage with the same potential may be applied to the first mounting terminal, the third mounting terminal and the fifth mounting terminal. Further, a voltage with the same potential may be applied to the second mounting terminal, the fourth mounting terminal, and the sixth mounting terminal.

The fifth mounting terminal is arranged adjacent to the first mounting terminal and the third mounting terminal, and hence electric coupling is established easily. The sixth mounting terminal is arranged adjacent to the second mounting terminal and the fourth mounting terminal, and hence electric coupling is established easily. Thus, a voltage with the same potential can be easily applied to the first mounting terminal, the third mounting terminal, and the fifth mounting terminal. Further, a voltage with the same potential can be easily applied to the second mounting terminal, the fourth mounting terminal, and the sixth mounting terminal.

The electro-optical device described above may further include a substrate at which the first high potential line, the first low potential line, the second high potential line, and the second low potential line are arranged, and a flexible printed wiring substrate coupled to the substrate, wherein the flexible printed wiring substrate may include a drive IC, a first wiring line, a second wiring line, a third wiring line, and a fourth wiring line, and the first wiring line electrically coupled to the first high potential line and the second wiring line electrically coupled to the first low potential line may extend through an inside of the drive IC, and the third wiring line electrically coupled to the second high potential line and the fourth wiring line electrically coupled to the second low potential line may extend through the inside of the drive IC.

With this configuration, the electro-optical device includes the flexible printed wiring substrate, and the drive IC is arranged on the flexible printed wiring substrate. The first wiring line electrically coupled to the first high potential line and the second wiring line electrically coupled to the first low potential line extend through the inside of the drive IC. The third wiring line electrically coupled to the second high potential line and the fourth wiring line electrically coupled to the second low potential line extend through the inside of the drive IC. Thus, arrangement of the first mounting terminal, the second mounting terminal, the third mounting terminal, and the fourth mounting terminal on the substrate can be adjusted easily.

An electronic apparatus includes the electro-optical device described in any one of the items given above.

With this configuration, the electronic apparatus includes the electro-optical device described above. The electro-optical device described above is a device capable of inspecting the first video line and the second video line with a simple terminal configuration even when the number of the first video line and the number of the second video line are large. Thus, the electronic apparatus can be an apparatus including the electro-optical device capable of inspecting the first video line and the second video line with a simple terminal configuration.

An inspection method for an electro-optical device, the electro-optical device including a first video line and a second video line being adjacent to each other, a first high potential line electrically coupled to the first video line via a first diode, a first low potential line electrically coupled to the first video line via a second diode, a second high potential line electrically coupled to the second video line via a third diode, and a second low potential line electrically coupled to the second video line via a fourth diode, the first diode having an anode electrically coupled to the first video line, the second diode having a cathode electrically coupled to the first video line, the third diode having an anode electrically coupled to the second video line, and the fourth diode having a cathode electrically coupled to the second video line, wherein, when voltages that are applied to the first high potential line, the first low potential line, the second high potential line, and the second low potential line are referred to as a first high potential, a first low potential, a second high potential, and a second low potential, respectively, voltages satisfying a relationship of the first high potential≥the first low potential>the second high potential≥the second low potential are applied to the first high potential line, the first low potential line, the second high potential line, and the second low potential line, respectively, and when a short circuit is caused between the first video line and the second video line, a current flowing through the first low potential line, the second diode, the first video line, a short circuit part, the second video line, the third diode, and the second high potential line in this order is detected, and the short circuit caused between the first video line and the second video lines is detected.

With this configuration, a current flowing between the first low potential line and the second high potential line is detected, and whether a short circuit is caused between the first video line and the second video line is detected. For short-circuit inspection, a method of measuring resistance between the first video line and the second video line is known. In this case, terminals are required to be arranged in the first video line and the second video line. In this method, a large number of terminals are required, and hence arrangement of the terminals with which a probe is brought into contact is difficult. As compared to this method, in this inspection method for an electro-optical device, the terminals that are electrically coupled to the first high potential line, the first low potential line, the second high potential line, and the second low potential line, respectively, are provided, and hence short-circuit inspection between the first video line and the second video line can be performed. Thus, even when the number of the first video lines and the number of the second video lines are large, inspection with excellent reliability can be performed without hindering size reduction.

What is claimed is:

1. An electro-optical device, comprising:

a first video line and a second video line adjacent to each other;

a first high potential line electrically coupled to the first video line via a first diode, an anode of the first diode being electrically coupled to the first video line;

a first low potential line electrically coupled to the first video line via a second diode, a cathode of the second diode being electrically coupled to the first video line;

a first mounting terminal and a first inspection terminal that are electrically coupled to the first high potential line;

a second mounting terminal and a second inspection terminal that are electrically coupled to the first low potential line;

a second high potential line electrically coupled to the second video line via a third diode, an anode of the third diode being electrically coupled to the second video line;

a second low potential line electrically coupled to the second video line via a fourth diode, a cathode of the fourth diode being electrically coupled to the second video line;

a third mounting terminal and a third inspection terminal that are electrically coupled to the second high potential line; and a fourth mounting terminal and a fourth inspection terminal that are electrically coupled to the second low potential line.

2. The electro-optical device according to claim 1, comprising:

a scan line driving circuit configured to transmit a scan signal;

a scan control line configured to supply a scan data signal to the scan line driving circuit;

a third high potential line electrically coupled to the scan control line via a fifth diode, an anode of the fifth diode being electrically coupled to the scan control line; and a third low potential line electrically coupled to the scan control line via a sixth diode, a cathode of the sixth diode being electrically coupled to the scan control line, wherein the third high potential line and the third low potential line are each electrically separated from the first high potential line, the first low potential line, the second high potential line, and the second low potential line.

3. The electro-optical device according to claim 2, comprising:

a fifth mounting terminal and a fifth inspection terminal that are electrically coupled to the third high potential line; and a sixth mounting terminal and a sixth inspection terminal that are electrically coupled to the third low potential line, wherein the fifth mounting terminal is arranged adjacent to the first mounting terminal or the third mounting terminal, and the sixth mounting terminal is arranged adjacent to the second mounting terminal or the fourth mounting terminal.

4. The electro-optical device according to claim 2, comprising:

a substrate at which the first high potential line, the first low potential line, the second high potential line, and the second low potential line are arranged; and a flexible printed wiring substrate coupled to the substrate, wherein the flexible printed wiring substrate includes a drive IC, a first wiring line, a second wiring line, a third wiring line, and a fourth wiring line, and the first wiring line electrically coupled to the first high potential line and the second wiring line electrically coupled to the first low potential line extend through the drive IC, and the third wiring line electrically coupled to the second high potential line and the fourth wiring line electrically coupled to the second low potential line extend through the drive IC.

5. An electronic apparatus comprising the electro-optical device according to claim 1.

6. An inspection method for an electro-optical device, the electro-optical device comprising:

a first video line and a second video line adjacent to each other;

a first high potential line electrically coupled to the first video line via a first diode, an anode of the first diode is electrically coupled to the first video line;

a first low potential line electrically coupled to the first video line via a second diode, a cathode of the second diode being electrically coupled to the first video line;

a second high potential line electrically coupled to the second video line via a third diode, an anode of the third diode being electrically coupled to the second video line; and a second low potential line electrically coupled to the second video line via a fourth diode, a cathode of the fourth diode being electrically coupled to the second video line, the inspection method comprising:

applying voltages satisfying a relationship of a first high potential≥a first low potential>a second high potential≥a second low potential to the first high potential line, the first low potential line, the second high potential line, and the second low potential line, respectively, the first high potential is applied to the first high potential line, a first low potential is applied to the first low potential line, a second high potential is applied to the second high potential line, and a second low potential is applied to the second low potential line; and detecting a short circuit between the first video line and the second video line, when the short circuit is caused between the first video line and the second video line, by detecting a current flowing through the first low potential line, the second diode, the first video line, a short circuit part, the second video line, the third diode, and the second high potential line in this order.

* * * * *